US006458500B1

(12) United States Patent
Zhao et al.

(10) Patent No.: US 6,458,500 B1
(45) Date of Patent: Oct. 1, 2002

(54) IMAGING APPARATUS

(75) Inventors: Weizhong Zhao, Webster, NY (US); David H. Pan, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 25 days.

(21) Appl. No.: 09/777,301

(22) Filed: Feb. 6, 2001

(51) Int. Cl.[7] ..... G03G 15/00; G03G 9/135
(52) U.S. Cl. ..... 430/117; 430/115; 399/133
(58) Field of Search ..... 430/115, 117; 399/237, 296, 133

(56) References Cited

U.S. PATENT DOCUMENTS

| | | | | |
|---|---|---|---|---|
| 4,504,138 | A | 3/1985 | Kuehnle et al. | 355/10 |
| 4,707,429 | A | 11/1987 | Trout | 430/115 |
| 5,019,477 | A | 5/1991 | Felder | 430/115 |
| 5,028,508 | A | 7/1991 | Lane et al. | 430/115 |
| 5,030,535 | A | 7/1991 | Drappel et al. | 430/116 |
| 5,034,299 | A | 7/1991 | Houle et al. | 430/115 |
| 5,045,425 | A | 9/1991 | Swidler | 430/115 |
| 5,066,821 | A | 11/1991 | House et al. | 430/137 |
| 5,198,864 | A | 3/1993 | Fletcher | 355/274 |
| 5,223,368 | A | 6/1993 | Ciccarelli et al. | 430/110 |
| 5,306,591 | A | 4/1994 | Larson et al. | 430/115 |
| 5,308,731 | A | 5/1994 | Larson et al. | 430/115 |
| 5,324,613 | A | 6/1994 | Ciccarelli et al. | 430/110 |
| 5,346,795 | A | 9/1994 | Pickering et al. | 430/110 |
| 5,366,840 | A | 11/1994 | Larson et al. | 430/115 |
| 5,387,760 | A | 2/1995 | Miyazawa et al. | 118/661 |
| 5,428,429 | A | 6/1995 | Fletcher | 355/272 |
| 5,436,706 | A | 7/1995 | Landa et al. | 355/256 |
| 5,519,473 | A | 5/1996 | Morehouse, Jr. et al. | 355/256 |
| 5,563,015 | A | 10/1996 | Bonsignore et al. | 430/106 |
| 5,619,313 | A | 4/1997 | Domoto et al. | 399/233 |
| 5,627,002 | A | 5/1997 | Pan et al. | 430/115 |
| 5,672,456 | A | 9/1997 | Chamberlain et al. | 430/115 |
| 5,826,147 | A | 10/1998 | Liu et al. | 399/237 |
| 5,937,243 | A | 8/1999 | Liu et al. | 399/130 |
| 5,966,570 | A | 10/1999 | Till et al. | 399/133 |
| 5,987,283 | A * | 11/1999 | Zhao et al. | |

* cited by examiner

*Primary Examiner*—John Goodrow
(74) *Attorney, Agent, or Firm*—E. O. Palazzo

(57) ABSTRACT

An imaging apparatus including a support member including a support surface for supporting a layer of marking material;

a marking material supply apparatus for depositing marking material on the surface of the support member to form a layer of marking material thereon;

a charging source for selectively delivering charge species to the layer of marking material in an imagewise manner to form an electrostatic latent image in the layer of marking material, wherein the electrostatic latent image includes image areas defined by a first charge voltage and nonimage areas defined by a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of a cyclodextrin.

33 Claims, 5 Drawing Sheets

IMAGING APPARATUS

COPENDING APPLICATIONS AND PATENTS

In copending application U.S. Ser. No. 09/777,423, filed concurrently herewith, the disclosure of which is totally incorporated herein by reference, there is illustrated a liquid developer comprised of a nonpolar liquid, thermoplastic resin, colorant, and a silica charge acceptance additive; U.S. Pat. No. 6,335,136, the disclosure of which is totally incorporated herein by reference, illustrates a liquid developer comprised of a nonpolar liquid, thermoplastic resin, colorant, and a wax charge acceptance additive; U.S. Pat. No. 6,372,402, the disclosure of which is totally incorporated herein by reference, illustrates a liquid developer comprised of a nonpolar liquid, thermoplastic resin, optional colorant, and an Inorganic filler; U.S. Pat. No. 6,346,357, the disclosure of which is totally incorporated herein by reference, illustrates a liquid developer comprised of a nonpolar liquid, thernoplastic resin, optional colorant, and an alumina charge acceptance additive: U.S. Pat. No. 6,348, 292, the disclosure of which is totally incorporated herein by reference, illustrates a liquid developer comprised of a nonpolar liquid, resin, optional colorant, and an alkaline earth charge acceptance additive; and U,S. Ser. No. 09/777, 968, filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the eloctrostatic latent image includes image areas with a first charge voltage and nonimage areas with a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of an aluminum complex.

Illustrated in U.S. Pat. No. 6,218,066, "Developer Compositions and Processes", filed Jan. 27, 2000, U.S. Pat. No. 6,180,308, "Developer Compositions and. Processes", filed Jan. 27, 2000, and U.S. Pat No. 6,212,347, "Imaging Apparatus", filed Jan. 27, 2000, the disclosures of each application being totally incorporated herein by reference, are developers with charge acceptance component, imaging processes, and imaging apparatus thereof.

illustrated in U.S. Pat. No. 6,187,499, "Imaging Apparatus", filed Jan. 27, 2000, the disclosure of which is totally incorporated herein by reference, is an imaging apparatus comprising.

an imaging member with an electrostatic latent image formed thereon, the imaging member containing a surface capable of supporting marking material;

an imaging device for generating the electrostatic latent image on the imaging member, wherein the electrostatic latent image includes image areas defined by a first charge voltage and nonimage areas defined by a second charge voltage distinguishable from the first charge voltage;

a marking material supply apparatus for depositing marking material on the surface of the imaging member to form a marking material layer thereon adjacent the electrostatic latent image on said imaging member;

a charging source for selectively delivering charges to the marking material layer in an imagewise manner responsive to the electrostatic latent image on the imaging member to form a secondary latent image in the marking material layer having image and nonimage areas corresponding to the electrostatic latent image on said imaging member; and a separator member for selectively separating portions of the marking material layer in accordance with the secondary latent image in the marking material layer to create a developed image corresponding to the electrostatic latent image formed on the imaging member, and wherein said marking material is comprised of a liquid developer comprised of an optional nonpolar liquid, resin, colorant, and a charge acceptance component comprised of a cyclodextrin.

Illustrated in U.S. Pat. No. 5,966,570, the disclosure of which is totally incorporated herein by reference, is an imaging apparatus, comprising:

support member including a support surface for supporting a layer of marking material;

a marking material supply apparatus for depositing marking material on the surface of the support member to form the layer of marking material thereon;

a charging source for selectively delivering charge species to the layer of marking material in an imagewise manner to form an electrostatic latent image in the layer of marking material, wherein the electrostatic latent image includes image areas defined by a first charge voltage and nonimage areas defined by a second charge voltage distinguishable from the first charge voltage; and a separator member for selectively separating portions of the marking material layer in accordance with the latent image in the marking material layer to create a developed image.

Illustrated in U.S. Pat. No. 5,627,002, the disclosure of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups. A number of the appropriate components of this patent, especially the cyclodextrins, may be selected for the invention of the present application in embodiments thereof, and wherein with the present invention the cyclodextrins, especially beta-cyclodextrin function as a charge, either positive, or negative, acceptance component, agent, or additive.

In U.S. Pat. Nos. 5,366,840; 5,346,795 and 5,223,368, the disclosures of which are totally incorporated herein by reference, there are illustrated developer compositions with aluminum complex components and which components may be selected as a charge acceptance additive for the developers of the present invention.

Disclosed in U.S. Pat. No. 5,826,147, the disclosure of which is totally incorporated herein by reference, is an electrostatic latent image development process and an apparatus thereof.wherein there is selected an imaging member with an imaging surface containing a layer of marking material and wherein imagewise charging can be accomplished with a wide beam ion source such that free mobile ions are introduced in the vicinity of an electrostatic image associated with the imaging member.

The appropriate components and processes of the above copending applications and patents may be selected for the present invention in embodiments thereof.

BACKGROUND OF THE INVENTION

This invention is generally directed to liquid developer compositions and processes thereof, and wherein there can be generated excellent developed images thereof in, for example, an imaging apparatus, comprising a support member including a support surface for supporting a layer of marking material;

a marking material supply apparatus for depositing marking material on the surface of the support member to form the layer of marking material thereon;

a charging source for selectively delivering charge species to the layer of marking material in an imagewise manner to form an electrostatic latent image in the layer of marking material, wherein the electrostatic latent image includes image areas defined by a first charge voltage and nonimage areas defined by a second charge voltage distinguishable from the first charge voltage; and a separator member for selectively separating portions of the marking material layer in accordance with the latent image in the marking material layer to create a developed image, and wherein there is selected as the marking material a liquid developer containing a charge acceptance agent, such as a cyclodextrin, or an aluminum complex, and wherein the developer contains no charge director, or wherein the developer contains substantially no charge director. Preferably, the liquid developer of the present invention is clear in color and is comprised of a resin, a hydrocarbon carrier, and as a charge acceptor a polyethylene oxide-polypropylene oxide, Alohas, an aluminum-di-tertiary butyl salicylate, as illustrated, for example, in U.S. Pat. No. 5,563,015, the disclosure of which is totally incorporated herein by reference, including a mixture of Alohas and EMPHOS PS-900®, a cyclodextrin charge acceptance agent, or charge acceptance additive component, and an optional colorant.

The liquid developers and processes of the present invention possess in embodiments thereof a number of advantages including the development and generation of images with improved image defects, such as smears and hollowed fine features, the avoidance of a charge director, the use of the developers in a reverse charging development process, excellent image transfer, and the avoidance of complex chemical charging of the developer. Poor transfer can, for example, result in poor solid area coverage if insufficient toner is transferred to the final substrate. Conversely, overcharging the toner particles may result in low reflective optical density images, poor color richness or chroma since only a few very highly charged particles can discharge all the charge on the dielectric receptor causing too little toner to be deposited. To overcome or minimize such problems, the liquid toners, or developers, apparatuses, and processes of the present invention were arrived at after extensive research. Other advantages are as illustrated herein and also include minimal or no image blooming, the generation of excellent solid area images, minimal or no developed image character defects, and the like.

PRIOR ART

A latent electrostatic image can be developed with toner particles dispersed in an insulating nonpolar liquid. These dispersed materials are known as liquid toners, toner or liquid developers. The latent electrostatic image may be generated by providing a photoconductive imaging member (PC) or layer with a uniform electrostatic charge, and developing the image with a liquid developer, or colored toner particles dispersed in a nonpolar liquid which generally has a high volume resistivity in excess of about $10^9$ ohm-centimeters, a low dielectric constant, for example below about 3, and a moderate vapor pressure. Generally, the toner particles of the liquid developer are less than about or equal to about 30 $\mu$m (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate.

U.S. Pat. No. 5,030,535, the disclosure of which is totally incorporated herein by reference, discloses a liquid developer composition comprising a liquid vehicle, a charge additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. No. 5,045,425. Stain elimination in consecutive colored liquid toners are illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Lithographic toners with cyclodextrins as antiprecipitants, and silver halide developers with cyclodextrins are known, reference U.S. Pat. Nos. 5,409,803, and 5,352,563, the disclosures of which are totally incorporated herein by reference.

Illustrated in U.S. Pat. No. 5,306,591 is a liquid developer comprised of a liquid component, thermoplastic resin, an ionic or zwitterionic charge director, or directors soluble in a nonpolar liquid, and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents, and the Statutory Registration being totally incorporated herein by reference.

U.S. Pat. No. 4,504,138, the disclosure of which is totally incorporated herein by reference, discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image.

U.S. Pat. No. 5,387,760, the disclosure of which is totally incorporated herein by reference, discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706, the disclosure of which is totally incorporated herein by reference, discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313, the disclosure of which is totally incorporated herein by reference, discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and imagewise dissipating charge from selected portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

U.S. Pat. No. 5,826,147, the disclosure of which is totally incorporated herein by reference, discloses a. novel image development method and apparatus, wherein an imaging member having an imaging surface is provided with a layer of marking material thereon, and an electrostatic latent image is created in the layer of marking material. Imagewise charging of the layer of marking material is accomplished by means of a wide beam ion source such that free mobile ions are introduced in the vicinity of an electrostatic latent image associated with the imaging member having the layer of marking material coated thereon. The latent image associated with the imaging member causes the free mobile ions to flow in an imagewise ion stream corresponding to the latent image, which, in turn, leads to imagewise charging of the toner layer such that the toner layer itself becomes the latent image carrier. The latent image carrying toner layer is subsequently developed and transferred to a copy substrate to produce an output document.

U.S. Pat. No. 5,937,243, the disclosure of which is totally incorporated herein by reference, discloses a novel image development method and apparatus, whereby imagewise charging of a toner layer is accomplished by induced air breakdown electrical discharge such that free mobile ions are introduced in the vicinity of an electrostatic latent image coated with a layer of developing material. The latent image causes the free mobile ions to flow in an imagewise ion stream corresponding to the latent image, which, in turn, leads to imagewise charging of the toner layer, such that the toner layer itself becomes the latent image carrier. The latent image carrying toner layer is subsequently developed and transferred to a copy substrate to produce an output document.

FIGURES AND DESCRIPTION THEREOF

These and other aspects of the present invention will become apparent from the following description in conjunction with the accompanying drawings in which FIG. 1 is a schematic elevational view depicting a system and process for imagewise toner layer charging and development in accordance with the present invention;

Figure 4:
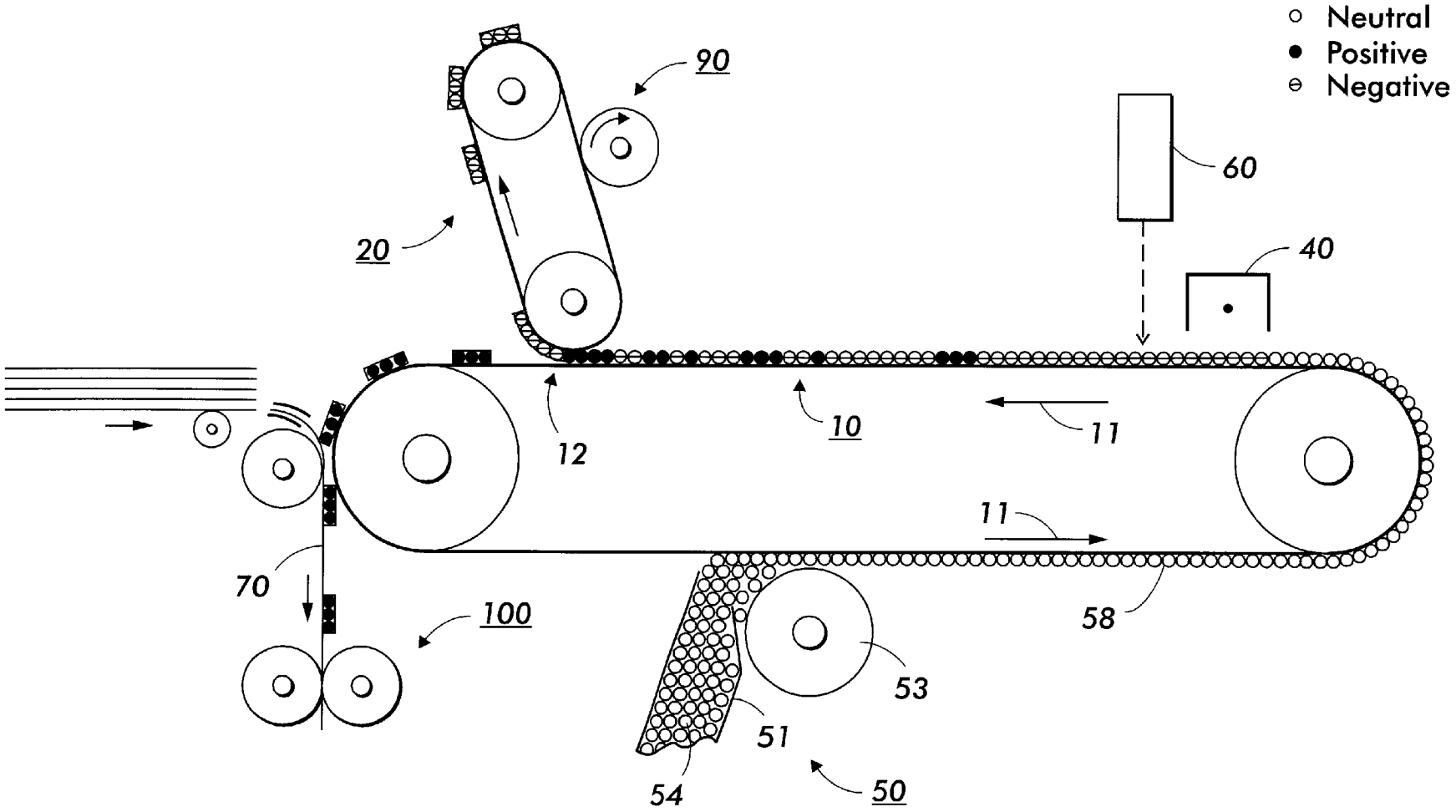
Figure 5:
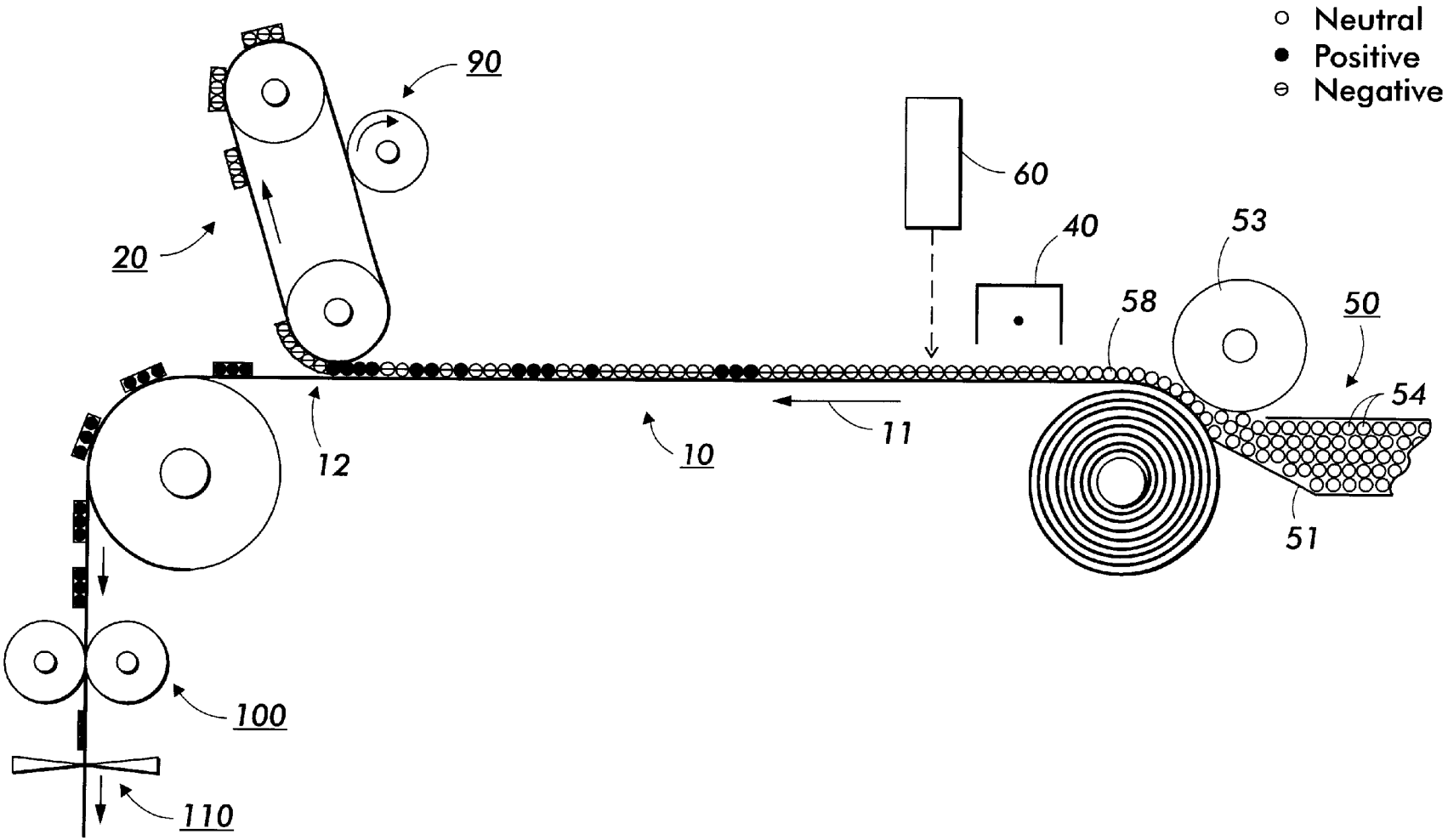

FIG. 4 is a schematic elevational view of an alternative embodiment for a system incorporating a belt-type imaging member and other variant subsystems to provide imagewise toner layer charging and selective separation of the imagewise charged toner layer to produce an output image in accordance with the present invention; and FIG. 5 is a schematic electrical view of another alternative embodiment for imagewise toner layer charging in accordance with the present invention, wherein the toner layer, latent image and output image are formed directly on the toner layer support member.

Figure 1:
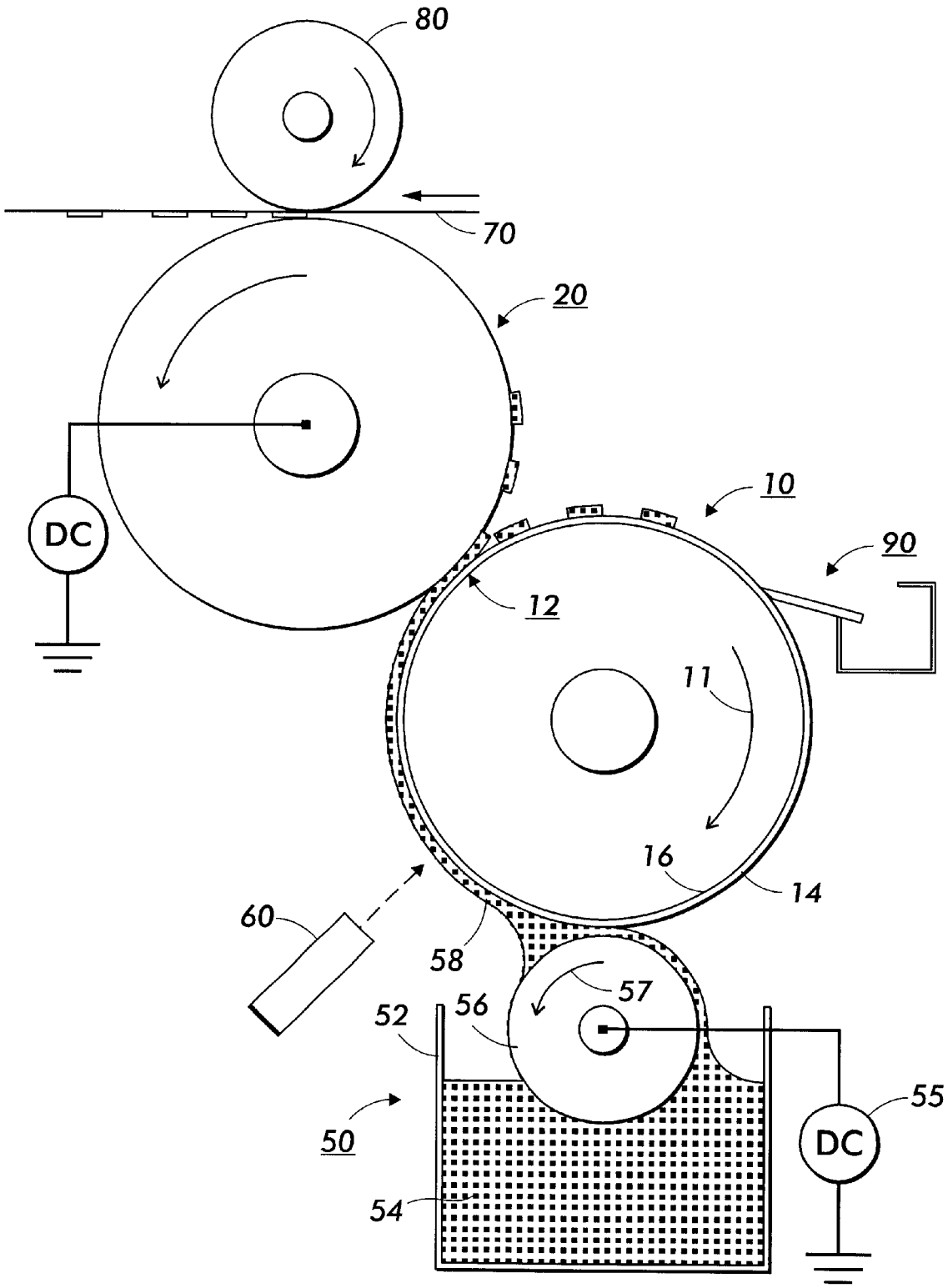

With reference to FIG. 1, an exemplary imaging apparatus capable of imagewise toner (liquid developer) charging in accordance with the present invention is illustrated, comprising an assemblage of operatively associated image forming elements, including a toner layer support member 10 situated in contact with an image separating member 20 at an image separating nip 12 formed therebetween. Toner layer support member 10 includes a surface of any type capable of having a layer of developing material, either powder or liquid, wherein there can be deposited from the liquid the toner solids thereof, formed thereon. An exemplary toner layer support member 10 may include a relatively thin surface layer 14 comprising a conductive material, an insulative material, a thin dielectric material of the type known to those of skill in the art of ionography, a semiconductive material, or any other material which may be contemplated for use in a typical electrostatographic imaging system or otherwise. The surface layer 14 may be supported on an electrically conductive and preferably grounded support substrate 16. The toner layer support member 10 is rotated, as indicated by arrow 11, so as to transport the surface thereof in a process direction for implementing a series of image forming steps in accordance with the present invention. It will be understood that the present invention contemplates the use of various alternative embodiments for the toner layer support member which may include imaging members that are well known in the art of electrostatographic printing, including, for example, but not limited to, dielectric charge retaining member of the type generally used in ionographic printing machines.

A typical electrostatographic printing process involves the generation of an electrostatic latent image on the surface of an imaging member, and the subsequent step of selectively attracting marking particles in the form of charged toner particles to image areas of the electrostatic latent image. In the present invention, a substantially uniform layer of charged or uncharged marking or toner particles is deposited on the entire surface of a toner layer support member 10. To that end, a toner supply apparatus or applicator 50 is provided, as depicted in the exemplary embodiment of FIG. 1, whereby charged or uncharged marking or toner particles (and possibly some carrier mechanism such as a liquid solvent) are transported onto the surface of the toner layer support member 10 to form a layer 58 thereon. The exemplary embodiment of FIG. 1 shows an illustrative toner applicator 50, wherein a housing 52 is adapted to accommodate a supply of toner particles 54 and any additional carrier material, if necessary. In an exemplary embodiment, the toner applicator 50 includes an applicator roller 56 which is rotated in a direction as indicated by arrow 57 to transport toner from housing 52 into contact with the surface of the imaging member 10 forming a substantially uniformly distributed layer of toner, or a so-called "toner cake" 58 thereon.

The toner cake 58 can be created in various ways. The toner cake 58 may be made up of charged or uncharged toner particles. With regard to a toner cake of charged toner particles, the charge can be placed on the toner particles while in the housing 52, for example via ionic charge additives. Alternatively, the charge can be placed on the toner particles in the toner cake 58 by means of any known ionic charging device, such as a well known corona generating device, as depicted at element 40 of FIG. 4, as will be discussed.

Depending on the materials utilized in the printing process, as well as other process parameters, such as process speed and the like, the layer of toner particles possesses a sufficient thickness, preferably on the order of between about 2 and about 15 microns, and more preferably between about 3 and about 8 microns, may be formed on the surface of the toner layer support member 10 by merely providing adequate proximity and/or contact pressure between the applicator roller 56 and the toner layer support member 10. Alternatively, where the developing material comprises charged particles, electrical biasing may be employed to assist in actively moving the toner particles onto the surface of the toner layer support member 10. Thus, in one exemplary embodiment, the applicator roller 56 can be coupled to an electrical biasing source 55 for implementing a so-called forward biasing scheme, wherein the toner applicator 56 is provided with an electrical bias of sufficient magnitude to create electrical fields extending from the toner applicator roll 56 to the surface of the toner layer support member 10. These electrical fields cause toner particles to be transported to the surface of the toner layer member 10 for forming a substantially uniform layer of toner particles thereon.

It will be understood that various other devices or apparatus may be utilized for applying toner layer 58 to the surface of the toner layer support member 10, including various well known apparatus analogous to development devices used in conventional electrostatographic applications, such as, but not limited to, powder cloud systems which transport developing material through a gaseous medium, such as air brush systems which transport developing material to the toner layer support member by means of a brush or similar member, and cascade systems which transport developing material to the toner layer support member by means of a system for pouring or cascading the toner particles onto the surface of the toner layer support member. In addition, various systems directed toward the transportation of liquid developing material having toner particles immersed in a carrier liquid can be incorporated into the present invention. Examples of such a liquid transport system can include a fountain-type device as disclosed generally in commonly assigned U.S. Pat. No. 5,519,473, the disclosure of which is totally incorporated herein by reference, or any other system capable of causing the flow and transport of liquid developing material, including toner particles immersed in a liquid carrier medium, onto the surface of the imaging member. With liquid developing materials, it is desirable that the toner cake formed on the surface of the toner layer support member 10 be comprised of less than about 10 percent by weight toner solids, and preferably in the range of about 15 percent to about 35 percent by weight toner solids of, for example, resin, colorant and charge acceptance component.

With respect to the foregoing toner cake formation process and various apparatus therefor, it will be understood that the toner layer generated on the imaging member surface can be characterized as having a substantially uniform mass density per unit area on the surface of the toner layer support member 10. However, it is noted that some toner layer nonuniformity may be generated such that it is not a requirement of the present invention that the toner layer be uniform or even substantially uniformly distributed on the surface of the toner layer support member 10, so long as the toner layer covers, at a minimum, the desired image areas of the output image to be produced.

In accordance with the present invention, after the toner layer 58 is formed on the surface of the toner layer support member 10, the toner layer is selectively charged in an imagewise manner. Thus, as shown in the system of FIG. 1, a selectively controllable charging apparatus, illustrated schematically as device 60, is provided for producing an imagewise charge stream to direct ions, electrons or other charge species toward the layer of developing material 58 present on support member 10, as will be described. The imagewise charge stream causes the toner particles in layer 58 to become selectively charged in an imagewise manner for generating an electrostatic latent image in layer 58 made up of toner particles having distinguishable charge levels in image and nonimage areas corresponding to the latent image.

The process of generating a latent image in the toner cake layer 58 will be described in greater detail with respect to FIG. 2, where an initially charged toner cake 58 is illustrated, for purposes of simplicity only, as a uniformly distributed layer of negatively charged toner particles having the thickness of a single toner particle. The toner cake 58 resides on the surface of the toner layer support member 10 which is being transported from left to right past a selectively controllable charging apparatus 60. The primary function of the selectively controllable charging device 60 is to direct charge species toward the toner layer 58 on the toner layer support member 10. The charging device may be embodied as various. known devices, including, but not limited to, any of the variously known charge imaging devices available in the art including various solid state controllable charge devices and electron or ion sources of the type associated with ionographic image writing processes.

Figure 2:
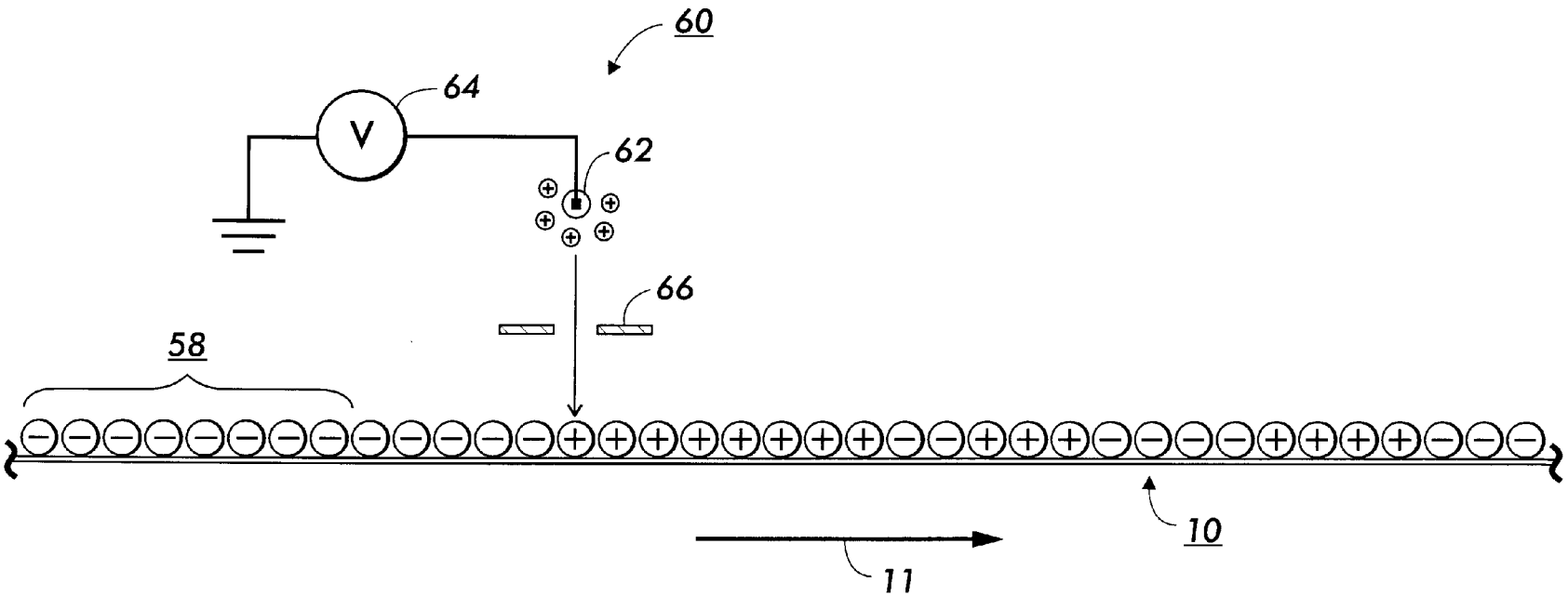
FIG. 2 is an exploded view illustrating imagewise charging of a toner layer by a selectively controllable charging device, wherein charge species in the form of ions are selectively delivered to a charged toner layer in accordance with a desired output image to reverse the charge thereon and to create a latent electrostatic image therein.

In an embodiment illustrated in FIG. 2, the selectively controllable charging apparatus 60 is shown as comprising a corona generating electrode 62 in combination with a charge deposition control device 66, whereby the originally uniformly charged layer of toner particles 58 on toner layer support member 10 is charged in imagewise fashion by ions emitted from corona generative device 66. In the type of device depicted in FIG. 2, the corona generating electrode 62 is situated generally adjacent the toner layer support member 10, across the width thereof. The electrode 62 or so called coronode is typically connected to a voltage source 64 capable of providing a relatively high voltage potential thereto for causing the air immediately surrounding the electrode to become ionized and generate ions thereabout, as represented by the plus signs in the vicinity of the coronode. Interposed between the source 62 and the surface of support member 10 is a charge deposition control device, generally indicated by reference numeral 66. The control device 66 includes a plurality of openings for selectively allowing the passage of ions generated by coronode 62 in the direction of support member 10 as the member moves in a process direction, indicated by arrow 11. The imagewise deposition of ions in the toner layer 58 on the moving support member 10 is caused by selective control of the apertures present in control device 66, either to permit or not permit the passage of ions therethrough in accordance with image data. Positive ions in the vicinity of negatively charged toner are attracted to the toner layer, and captured thereby. In this manner, the ions emitted from electrode 62 form the desired electrostatic latent image in toner layer 58 by coordination of the imagewise modulation of the ion flow through the openings in control device 66 with the motion of support member 10.

With respect to the process illustrated in FIG. 2, the function of the selectively controllable charge device 60 is to selectively reverse the charge present on the toner layer 58 in an imagewise manner. Selectively controllable charging apparatus of the type contemplated for use in the present invention for directing ions, electrons or other charge species in an imagewise manner are well known in the art of electrostatic imaging and, particularly, in the field of ionography. Other exemplary devices may include conventional multiplexed matrix electrode arrays, gated ion flow devices, electron field emission sources, control electrode structures, and thin film devices, among numerous other apparatus which are known in the art or may become known in the future. In addition, although the foregoing process has been described with respect to a positive ion source and a negatively charged toner layer, it will be understood that the process can also be implemented using a negative ion source and a positively charged toner layer. Alternatively, the process of the present invention can also be implemented using an uncharged or neutral toner layer, as will be described in greater detail as the present description proceeds. In the case of an imagewise charging of a charged toner layer, the process of the present invention requires that charging source 60 provide a charge stream having a charge polarity opposite the toner layer charge polarity.

Figure 3:
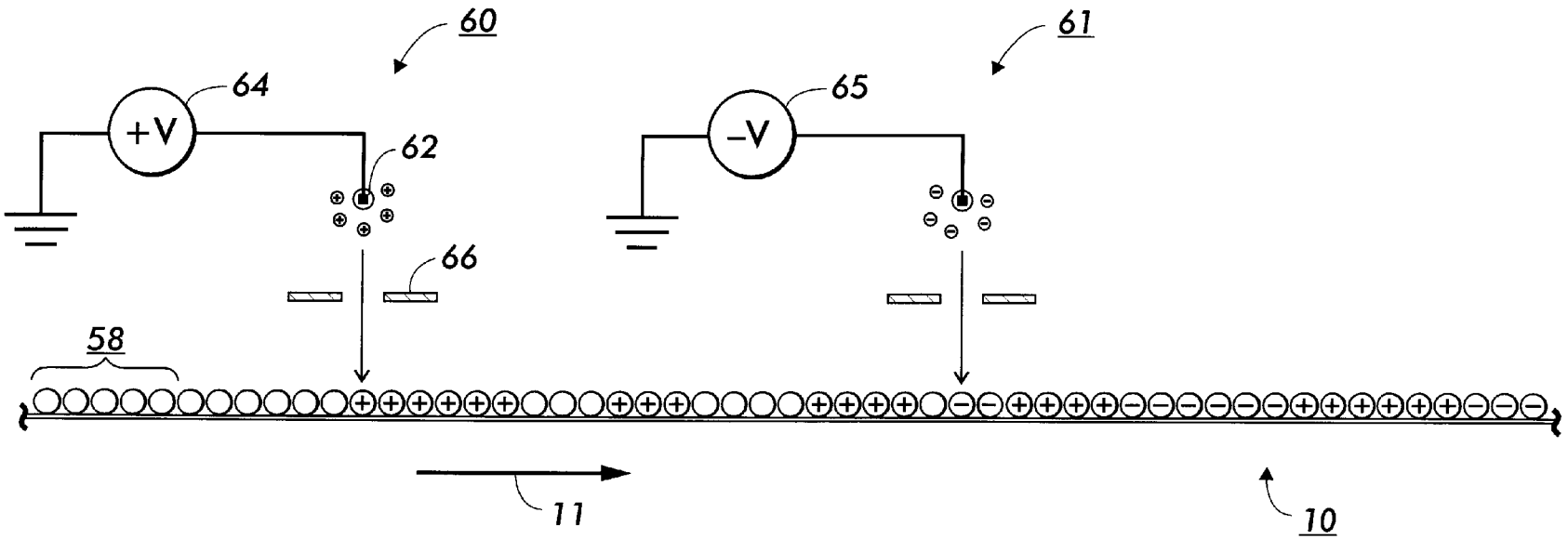
FIG. 3 is another exploded view illustrating imagewise toner layer charging of a neutrally charged toner layer in a manner similar to that depicted in FIG. 2.

In the above-described process, a charged toner layer is situated on a toner layer support surface, wherein the charged toner layer is selectively exposed to charged ions for selectively reversing the preexisting charge of the toner layer. Since the toner layer is initially charged, fringe fields, or field lines extending between image and nonimage regions of the latent image can affect the uniformity of the charged toner cake 58. While the existence of these fringe fields may be advantageous if the fringe fields can be properly controlled, these fringe fields may manifest themselves as image quality defects in the final output document. The present invention contemplates an alternative embodiment to the imagewise toner layer charging process described hereinabove, wherein the fringe field effect may be eliminated. This process is illustrated diagramatically in FIG. 3, wherein the original toner layer 58 being transported past the selective charging source is depicted with no charge. Thus, in an alternative embodiment of the present invention, the imagewise toner charging process of the present invention may be carried out using a neutrally charged toner cake 58 coated on the toner layer support member 10. The selectively controllable charging source 60, or multiple ion sources 60 and 61, as shown, are provided for presenting both negative and positive polarity charge species to the toner layer for oppositely charging regions of the toner layer 58 in accordance with image and nonimage areas of the latent image. In an exemplary embodiment, as illustrated in FIG. 3, a combination of two independent selectively controllable charging sources capable of providing opposite polarity charging species can be used. Optionally, alternative charge generating devices may be incorporated as a single AC driven device capable of providing both positive and negative charge ions.

In the exemplary embodiment of FIG. 3, the selectively controllable charge sources 60 and 61 are each independently driven by DC biasing sources 64 and 65, respectively, to provide opposite polarity charge streams. This embodiment operates in a manner similar to the embodiment of FIG. 2, wherein positive ions generated by charge source 60 are directed to the toner layer support 10 and captured by the neutrally charged toner layer 58 to define image areas of the latent image in the toner layer. Conversely, negative ions generated by charge. source 61 are absorbed or captured by the remaining neutral toner particles in the toner layer 58 to define nonimage areas of the latent image in the toner layer. It will be understood that this process can be reversed such that charging device 60 defines nonimage areas and charging device 61 defines image areas. Thus, the ions generated by ion sources 60 and/or 61 are selectively directed toward the toner layer 58 in accordance with the image and nonimage areas of the desired output. This process induces imagewise charging of the toner layer 58, creating a latent image within toner layer 58 made up of image and nonimage or background areas which are charged oppositely with respect to one another. Alternatively, but not necessarily preferably, a single charge device can be utilized to define either image or nonimage areas as charged particles with the remaining image or nonimage areas being defined by neutral charged particles. The neutral charged particles may tend to adhere to the toner cake image on nonimage areas on the toner layer support member 10, such that the dual charging embodiment depicted in FIG. 3 may be preferable for practicing the imagewise toner layer charging process of the present invention with respect to a neutrally charged toner cake.

Once the latent image is formed in toner layer 58, the latent image bearing toner layer is advanced to the image separator 20. Referring back to FIG. 1, image separator 20 may be provided in the form of a biased roll member having a surface adjacent to the surface of the toner layer support member 10 and preferably contacting the toner layer 58 residing on toner layer support member 10. An electrical biasing source is coupled to the image separator 20 for providing electrical bias to the image separator 20 for generating electrical fields in nip 12 so as to attract either image or nonimage areas of the latent image formed in the toner layer 58 for simultaneously separating and developing the toner layer 58 into image and nonimage portions. In the embodiment of FIG. 1, the image separator 20 is biased with a polarity opposite the charge polarity of the image areas in the toner layer 58 for attracting image areas therefrom, thereby producing a developed image made up of selectively separated and transferred portions of the toner cake on the surface of the image separator 20, while leaving background image byproduct on the surface of the toner layer support member 10. Alternatively, the image separator 20 can be provided with an electrical bias having a polarity appropriate for attracting nonimage areas away from the toner layer support member 10, thereby maintaining toner portions corresponding to image areas on the surface of the support member 10, yielding a developed image thereon, while nonimage or background areas are removed with the image separator 20.

After the developed image is created, either on the surface of the toner layer support member 10 or on the surface of the imaging separator 20, the developed image may then be transferred to a copy substrate 70 moving in the direction of the arrow via any means known in the art, which may include an electrostatic transfer apparatus, such as a suitable roller means 80, including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto. In a preferred embodiment, as shown in FIG. 1, the image is transferred to a copy substrate via a heated pressure roll, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, and the like), or other known fixation process which may include the introduction of a chemical fixing agent. Since the art of electrostatographic printing is well known, it is noted that several concepts for transfer and/or fusing, which could be beneficially used in combination with the imagewise charging system of the present invention, have been disclosed in the relevant patent literature.

In a final step in the process, the background image byproduct residing on either the toner layer support member 10 or the image separator 20 is removed from the surface thereof in order to clean the surface in preparation for a subsequent imaging cycle. FIG. 1 illustrates a simple blade cleaning apparatus for scraping the imaging member surface as is well known in the art. Altemative embodiments may include a brush or roller member for removing toner from the surface on which it resides. In a preferred embodiment, the removed toner associated with the background image is transported to a toner sump or other reclaim vessel so that the waste toner particles can be recycled and used again to produce a toner cake in subsequent imaging cycles. Once again, it is noted that several concepts for cleaning and toner reclaim which could be beneficially used in combination with the imagewise charging system of the present invention have been disclosed in the relevant patent literature.

The apparatus and processes described hereinabove represent some of the numerous system variants that could be implemented in the practice of the present invention. One particular variant printing system incorporating the teaching of the present invention will be described with respect to FIG. 4, wherein toner layer support member 10 is provided in the form of a belt entrained about a pair of roll members including a drive roller driven by a conventional motor device (not shown) for advancing the belt in a process direction along a curvilinear path, thereby transporting the upport member 10 through various processing stations disposed about the ath of movement thereof.

In the embodiment of FIG. 4, a neutrally charged toner cake is deposited on an uncharged toner layer support member 10 via a toner supply apparatus 50 including a fountain-type applicator 51 in combination with a metering roll 53. Metering roll 53 includes a peripheral surface situated in close proximity to the surface of toner layer support member 10, preferably rotated in a direction opposite to the direction of movement of the toner layer support member 10, providing a shear force against the toner layer deposited on the surface of the toner layer support member for controlling the thickness of the toner layer thereon. Thus, the metering roll 53 meters a predetermined amount of developing material (which may include toner particles immersed in liquid carrier). The excess material eventually falls away from the metering roll and may be transported to a sump for reuse in the toner applicator 51.

The neutrally charged toner layer deposited on the toner layer support member 10 may be uniformly charged prior to imagewise charging of the toner layer. To that end, the toner layer 58 is subsequently advanced to a charging station, shown to include a corona charging device 40. In this embodiment, the corona charging device 40 applies a charge to the neutrally charged toner layer 58 such that toner layer 58 will become charged. In this process, ions will be captured by the toner layer 58, generating a charge polarity therein, as illustrated by the negatively charged toner particles in FIG. 4.

The toner layer support member 10, now having charged toner layer 58 thereon, is next advanced to image charge station 60, which selectively charges the charged toner layer 58 to create an electrostatic latent image thereon, as described in detail hereinabove. As a result of the foregoing process steps, a layer of charged toner particles is positioned on the surface of the toner layer support member 10 with an imagewise ion stream being generated in the presence of the toner layer 58 on the toner layer support member 10, as described in greater detail previously herein with respect to FIG. 2.

In the embodiment of FIG. 4, image separator 20 is also provided in the form of a belt member entrained about a pair of opposed rollers. The image separator 20 is preferably driven by contact engagement with the toner layer support member 10, although a drive device could also be coupled to one of the rollers for providing transport motion to the image separator belt. In this embodiment, electrical bias may be applied to the roll member adjacent the imaging member in a manner disclosed swith respect to FIG. 1. Alternatively, electrical bias can be applied directly to the belt via a brush or well known commutator brush-type system. Such a commutator brush system may be desirable for permitting voltage variations in the nip 12 formed between the support member 10 and the image separator 20, thereby enabling a field tailoring approach at the transfer nip 12 similar to that disclosed in the prior art as, for example, in commonly assigned U.S. Pat. Nos. 5,198,864 and 5,428,429, the disclosures of which are totally incorporated herein by reference.

The embodiment of FIG. 4 contemplates using the image separator 20 to remove image background areas from the toner layer 58. Thus, the image separator 20 is biased so as to attract image background areas from the toner layer support member 10, thereby maintaining toner segments corresponding to image areas on the surface of the toner layer support member 10. Accordingly, the toner segments on image separator 20 are transported to a cleaning device 90, embodied as a roll member, while developed image areas remaining on the toner layer support member 10 are transported to a transfer station as typically found in a conventional electrostatographic printing machine. The toner segments making up the image are transferred to a copy substrate via any method which may be known in the art. The transferred image may thereafter be fused to the copy substrate at fusing station 100 and transported to an output device for retrieval by a machine operator.

Another particular variant printing system incorporating the teaching of the present invention is shown in FIG. 5, wherein toner layer support member 10 is provided in the form of a final support substrate such that the original toner layer, the latent image-bearing toner layer, and the output toner image are all formed thereon. In the illustrated embodiment of FIG. 5, the toner layer support member is provided in the form of a web comprising a coiled substrate material having the requisite conductive, semiconductive or dielectric properties necessary for carrying out the imagewise toner layer charging process of the present invention. Typical materials that might be utilized to form the web substrate may include dielectric or semiconductive coated paper or conductive sheet material of the type that may be used to produce canned products.

The process steps described with respect to FIG. 4 are similar to those of FIG. 5. A difference in the process of FIG. 5 is that once the image is formed on support member 10, the support member is transported to a cutter station 110 for generating the desired output form having an image thereon. It will be understood that the process steps shown with respect to FIG. 5 can be varied in any manner consistent with the teachings of the present invention described herein to generate the desired output image.

The present invention thus provides a novel image development method and apparatus, whereby imagewise charging is accomplished by a selectively controllable charging device such that charge species are selectively injected into a layer of developing material to generate an electrostatic latent image therein. An imagewise charge stream corresponding to the latent image leads to imagewise charging of the toner layer, such that the toner layer itself becomes the latent image carrier. The latent image carrying toner layer is subsequently developed and transferred to a copy substrate to produce an output document.

SUMMARY OF THE INVENTION

Examples of features of the present invention include

It is a feature of the present invention to provide a liquid developer with many of the advantages illustrated herein.

Another feature of the present invention resides in the provision of a liquid developer capable of modulated particle charging with, for example, corona ions for image quality optimization.

It is a further feature of the invention to provide positively charged, and/or negatively charged liquid developers wherein there are selected as charge acceptance agents or charge acceptance additives cyclodextrins, inclusive of organic basic nitrogenous derivatives of cyclodextrins, or aluminum complexes.

It is still a further feature of the invention to provide positively and negatively charged liquid developers wherein developed image defects, such as smearing, loss of resolution and loss of density, and color shifts in prints with magenta images overlaid with yellow images are eliminated or minimized.

Also, in another feature of the present invention there are provided positively charged liquid developers with certain charge acceptance agents that are in embodiments superior in some characteristics to liquid developers with no charge director in that they can be selected for ionographic contact electrostatic printing (ICEP) development, and wherein there can be generated high quality images. For ICEP, the image supporting layer surface usually does not carry a latent image; the charging source for selectively delivering charge to the marking material requires no latent image to assist in imagewise delivery, and there is usually only one latent image which is induced by the charging source.

Furthermore, in another feature of the present invention there are provided liquid toners that enable excellent image characteristics, and which toners enhance the positive charge of the resin selected, such as ELVAX® based resins.

These and other features of the present invention can be accomplished in embodiments by the provision of imaging apparatus containing liquid developers, and which developers contain a charge acceptance component.

Aspects of the present invention relate to an imaging apparatus, and wherein there is selected a liquid developer with a charge acceptance component and, more specifically, an imaging apparatus comprising support member including a support surface for supporting a layer of marking material;

a marking material supply apparatus for depositing marking material on the surface of the support member to form a layer of marking material thereon;

a charging source for selectively delivering charge species to the layer of marking material in an imagewise manner to form an electrostatic latent image in the layer of marking material, wherein the electrostatic latent image includes image areas of a first charge voltage and nonimage areas defined by a second charge voltage distinguishable from the first charge voltage; and a separator member for selectively separating portions of the marking material layer in accordance with the latent image in the marking material layer to create a developed image and wherein the marking material is comprised of a liquid developer comprised of a nonpolar liquid, resin, colorant, and a charge acceptance component comprised of a cyclodextrin; an imaging apparatus wherein the support member includes a layer of dielectric material; an imaging apparatus wherein the marking material supply apparatus is adapted to deposit a layer of uncharged marking particles on the surface of the support member; an imaging apparatus wherein the marking material supply apparatus is adapted to deposit a layer of electrically charged marking particles on the surface of the support member; an imaging apparatus wherein the marking material supply apparatus is adapted to deposit a marking material layer having a thickness of approximately 2 to 15 microns on the surface of the support member; an imaging apparatus wherein the marking material supply apparatus deposits a marking material, layer on the surface of the support member having a thickness in a range of between approximately 3 and 8 microns; an imaging apparatus wherein the marking material supply apparatus is adapted to accommodate liquid developing material including marking particles immersed in a liquid carrier medium; an imaging apparatus wherein the marking material supply apparatus is adapted to deposit a marking material layer having a solids percentage by weight of at least approximately 10 percent; an imaging apparatus wherein the marking material supply apparatus is adapted to deposit a marking material layer having a solids percentage by weight in a range of between about 15 percent and about 35 percent; an imaging apparatus wherein the marking material supply apparatus is adapted to supply a marking material layer having a substantially uniform density onto the surface of the support member; an imaging apparatus wherein the marking material supply apparatus includes: a housing adapted to accommodate a supply of marking particles therein; and a rotatably mounted applicator roll member for transporting marking particles from the housing to the surface of the support member; an imaging apparatus wherein the marking material supply apparatus further includes an electrical biasing source coupled to the applicator roll for applying an electrical bias thereto to generate electrical fields between the applicator roll and the support member so as to assist in forming the marking material layer on the surface of the support member; an imaging apparatus wherein the marking material supply apparatus includes a fountain-type applicator assembly for transporting a flow of marking particles into contact with the surface of the support member; an imaging apparatus wherein the marking material supply apparatus further includes a metering roll for applying a shear force to the marking material layer on the surface of the support member to control thickness thereof; an imaging apparatus wherein the charging source is adapted for creating an imagewise charge stream directed toward the marking material layer on the support member; an imaging apparatus wherein the charging source includes a corona generating electrode for emitting charge species having a predetermined charge polarity; and a charge deposition control device operatively interposed between the corona generating electrode and the support member having the layer of marking material thereon for directing charge species emitted from the corona generating electrode to the layer of marking material; an imaging apparatus wherein the charging source includes a plurality of independent corona generating electrodes and associated charge deposition control devices; an imaging apparatus wherein the plurality of independent corona generating electrodes includes a first corona generating electrode for providing charge species of a first charge polarity; and a second corona generating electrode for providing charge species of a second charge polarity; an imaging apparatus wherein the separator member is adapted to attract marking material layer image areas associated with the latent image away from the support member so as to maintain marking material layer nonimage areas associated with the latent image on the surface of the support member; an imaging apparatus wherein the separator member is adapted to attract marking material layer nonimage areas associated with the latent image away from the support member so as to maintain marking material layer image areas associated with the latent image on the surface of the support member; an imaging apparatus wherein the separator member includes a peripheral surface for contacting the marking material layer to selectively attract portions thereof away from the support member; an imaging apparatus wherein the separator member includes an electrical biasing source coupled to the peripheral surface for electrically attracting selectively charged portions of the marking material layer; an imaging apparatus further including a transfer system for transferring the developed image to a copy substrate to produce an output copy thereof; an imaging apparatus wherein the transfer system includes a system for substantially simultaneously fixing the image to the copy substrate; an imaging apparatus further including a fusing system for fusing the transferred image to the copy substrate; an imaging apparatus further including a cleaning apparatus for removing marking material layer nonimage areas associated with the latent image from the surface of the support member; an imaging apparatus further including a cleaning apparatus for removing marking material layer nonimage areas associated with the latent image from the surface of the separator member; an imaging process comprising depositing from a liquid developer toner particles on a support member to form a toner layer thereon;

selectively delivering charges to the toner layer on the support member in an imagewise manner for forming an electrostatic latent image in the toner layer having image areas defined by a first charge voltage and nonimage areas defined by a second charge voltage distinguishable from the first charge voltage; and selectively separating portions of the toner layer from the support member in accordance with the latent image in the toner layer for creating a developed image, and wherein the liquid developer is comprised of a liquid, colorant, resin, and a charge acceptance agent; an imaging process wherein the toner depositing step includes depositing a layer of uncharged toner particles on the surface of the support member; an imaging process wherein the toner depositing step includes depositing a layer of charged toner particles on the surface of the support member; an imaging process wherein the toner depositing step includes forming a toner layer having a thickness of approximately 2 to 15 microns on the surface of the support member; an imaging process wherein the toner depositing step includes forming a toner layer having a thickness in a range of between approximately 3 and about 8 microns on the surface of the support member; an imaging process wherein the toner depositing step includes depositing liquid developing material including toner particles immersed in a liquid carrier medium; an imaging process wherein the toner depositing step is adapted to deposit a toner layer having a toner solids percentage by weight of at least approximately 10 percent; an imaging process wherein the toner depositing step is adapted to deposit a toner layer having a toner solids percentage by weight in a range between approximately 15 percent and about 35 percent; an imaging process wherein the toner depositing step is adapted to deposit a toner layer having a substantially uniform density onto the surface of the support member; an imaging process wherein the step of selectively delivering charges to the toner layer is adapted for creating an imagewise charge stream directed toward the toner layer on the support member; an imaging process wherein the step of selectively delivering charges to the toner layer is adapted to generate charge species having a single charge polarity in the vicinity of the support member having the toner layer supported thereon; an imaging process wherein the step of selectively delivering charges to the toner layer is adapted to generate charge species having first and second charge polarities in the vicinity of the support member having the toner layer supported thereon; an imaging process wherein the step of selectively delivering charges to the toner layer includes a first step for generating charge species having a first charge polarity in the vicinity of the support member having the toner layer supported thereon; and a second step for generating charge species having a second charge polarity in the vicinity of the support member having the toner layer supported thereon; an imaging process wherein the step of selectively separating portions of the toner layer from the support member includes the step of attracting toner layer image areas associated with the latent image away from the support member so as to maintain toner layer nonimage areas associated with the latent image on the surface of the support member; an imaging process wherein the step of selectively separating portions of the toner layer from the support member includes the step of attracting toner layer nonimage areas associated with the latent image away from the support member so as to maintain toner layer image areas associated with the latent image on the surface of the support member; an imaging process wherein the step of selectively separating portions of the toner layer from the support member includes providing a member having a peripheral surface for contacting the toner layer to selectively attract portions thereof away from the support member; an imaging process wherein the step of selectively separating portions of the toner layer from the support member further includes providing an electrical bias to the member having a peripheral surface for contacting the toner layer to electrically attract selectively charged portions of the toner layer away from the support member; an imaging process further including a transfer step for transferring the developed image to a copy substrate to produce an output copy thereof; an imaging process wherein the transfer step further includes the step of substantially simultaneously fixing the image to the copy substrate; an imaging process further including a fusing step for fusing the transferred image to the copy substrate; an imaging process further including a cleaning step for removing toner layer nonimage areas associated with the latent image from the surface of the support member; an imaging process further including a cleaning step for removing toner layer nonimage areas associated with the latent image from a surface of a separator member; an electrostatographic image development apparatus, comprising means for depositing a layer of marking particles on a support member;

means for creating a selective electrical discharge in a vicinity of the layer of marking particles on the support member to selectively charge the layer of marking particles so as to create an electrostatic latent image in the layer of marking particles; and means for selectively separating portions of the layer of marking particles in accordance with the electrostatic latent image for creating a developed image corresponding to the electrostatic latent image formed in the layer of marking particles, and wherein the marking particles are comprised of a resin, colorant, and a cyclodextrin charge acceptance component; an electrostatographic image development apparatus wherein the layer of marking particles deposited on the support member includes uncharged or electrically charged toner particles of colorant, resin and cyclodextrin; an electrostatographic image development apparatus wherein the layer of marking particles deposited on the support member includes electrically charged toner particles; an electrostatographic image development apparatus wherein the layer of marking particles on the support member has a thickness of approximately 2 to about 15 microns; an electrostatographic image development apparatus wherein the layer of marking particles on the support member has a thickness in a range of between approximately 3 and about 8 microns; an electrostatographic image development apparatus wherein the layer of marking particles on the support member comprises liquid developing material including toner particles immersed in a liquid carrier medium; an electrostatographic image development apparatus wherein the liquid developing material includes a toner solids percentage by weight of at least approximately 10 percent; an electrostatographic image development apparatus wherein the liquid developing material includes a toner solids percentage by weight in a range of between about 15 percent and about 35 percent; an image development apparatus wherein the layer of marking particles on the support member has a substantially uniform thickness; an electrostatographic image development apparatus wherein the means for creating an electrical discharge provides charge species proximate to the support member having the toner layer supported thereon for creating an imagewise charge stream directed toward the toner layer on the support member; an electrostatographic image development apparatus wherein the means for creating an electrical discharge includes means for creating an imagewise charge stream having a single charge polarity; an electrostatographic image development apparatus wherein the means for creating an imagewise charge stream includes corona generating means for emitting charged ions; and charge deposition control means for selectively directing the charged ions toward the toner layer to be captured thereby; an electrostatographic image development apparatus wherein the means for creating an electrical discharge includes a plurality of independently biased corona generating means and associated charge deposition control means; an electrostatographic image development apparatus wherein the plurality of independent corona generating means includes a first corona generating electrode for providing charge species of a first charge polarity; and a second corona generating electrode for providing charge species of a second charge polarity; an electrostatographic image development apparatus wherein the selective separating means includes a peripheral surface for contacting the layer of marking particles to selectively attract portions. thereof away from the support member; an electrostatographic image development apparatus wherein the selective separating means removes image areas of the latent image in the layer of marking particles so as to maintain nonimage areas of the latent image in the layer of marking particles on the surface of the support member; an electrostatographic image development apparatus wherein the selective separating means removes nonimage areas of the latent image in the layer of marking particles so as to maintain image areas of the latent image in the layer of marking particles on the surface of the support member; an electrostatographic image development process comprising depositing a layer of marking particles on a support member;

selectively charging the layer of marking particles for creating an electrostatic latent image in the layer of marking particles; and selectively separating portions of the layer of marking particles in accordance with the electrostatic latent image for creating a developed image, and wherein the marking particles are comprised of resin, colorant, and a cyclodextrin charge acceptance component; an electrostatographic image development process wherein the layer of marking particles on the support member includes uncharged toner particles; an electrostatographic image development process wherein the layer of marking particles on the support member includes electrically charged toner particles; an electrostatographic image development process wherein the step of depositing a layer of marking particles on the support member includes the step of depositing a substantially uniform thickness layer of marking particles onto the support member; an electrostatographic image development process wherein the selective charging step includes directing an imagewise charge stream to the support member having the layer of marking particles supported thereon such that charge species are captured in an imagewise manner by the layer of marking particles on the support member to create the latent image therein; an electrostatographic image development process wherein the selective charging step includes creating an imagewise charge stream having a single charge polarity; an electrostatographic image development process wherein the selective charging step is adapted to create a plurality of imagewise charge stream having first and second charge polarities; an electrostatographic image development process wherein the selective separating step includes the step of removing image areas of the latent image from the layer of marking particles so as to maintain nonimage areas of the latent image in the layer of marking particles on the surface of the support member; an electrostatographic image development process wherein the selective separating step includes the step of removing nonimage areas of the latent image in the layer of marking particles so as to maintain image areas of the latent image in the layer of marking particles on the surface of the support member; an image development apparatus comprising a system for generating an electrostatic latent image in a toner layer by means of a selectively controllable charging device, wherein the electrostatic latent image includes image and nonimage areas having distinguishable charge potentials corresponding to image and nonimage areas in an image to be developed; a process for image development comprising the step of selectively directing charge toward a toner layer for generating an electrostatic latent in the toner layer to form a toner layer having an embedded electrostatic latent image therein defined by distinguishable charge potentials corresponding to image and nonimage areas; an electrostatographic image development apparatus comprising a support member including a surface having a layer of marking material thereon; and means for embedding an electrostatic latent image in the layer of marking material; an electrostatographic image development process for developing an image on a support member comprising providing a layer of marking material on a surface of the support member; and embedding an electrostatic latent image in the layer of marking material; an apparatus wherein the charge acceptance component is comprised of unsubstituted alpha, beta or gamma cyclodextrin or mixtures thereof of the following formulas

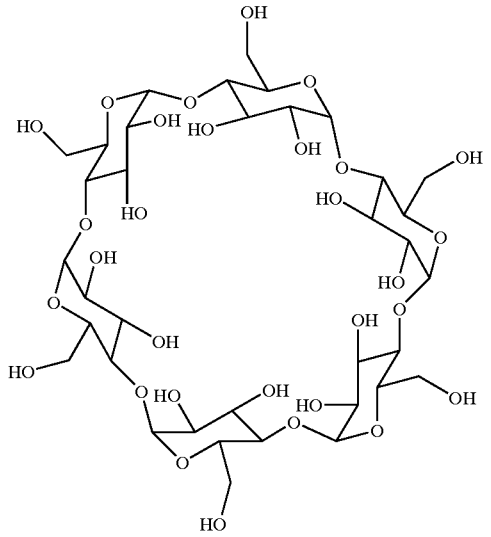

alpha-Cyclodextrin: 6 D-glucose rings containing 18 hydroxyl groups;

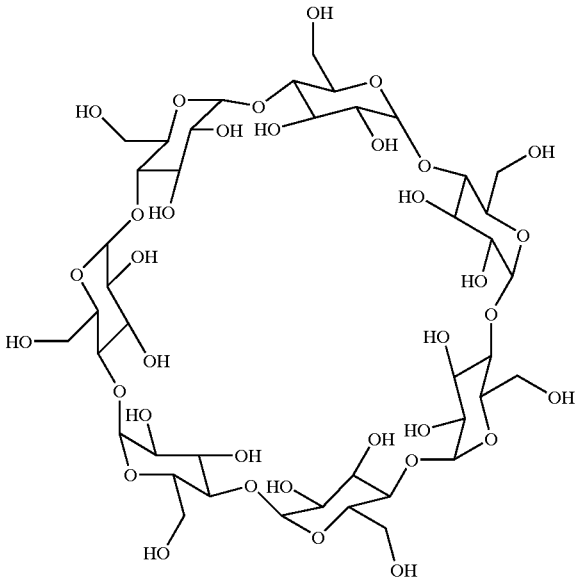

beta-Cyclodextrin: 7 D-glucose rings containing 21 hydroxyl groups; or

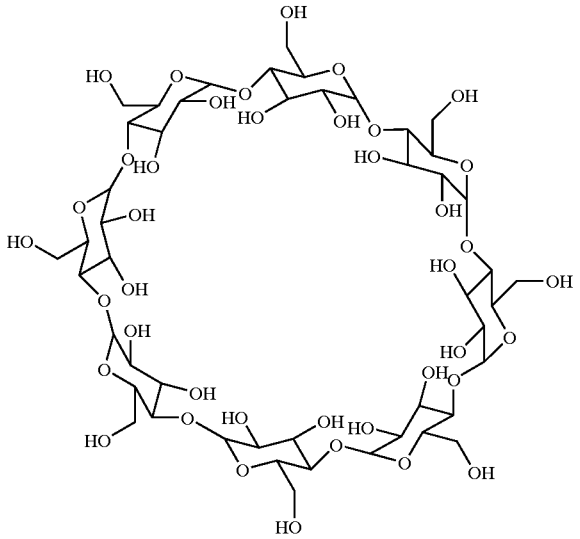

gamma-Cyclodextrin: 8 D-glucose rings containing 24 hydroxyl groups; an apparatus wherein the charge acceptance component is comprised of a tertiary aliphatic amino derivative of alpha, beta or gamma cyclodextrin or mixtures thereof of the following formulas wherein n is an integer of from 2 to 30, and $R^1$ and $R^2$ is an alkyl group containing from 2 to 30 carbons, or an alkylaryl group containing from 7 to 31 carbons, or a cycloalkyl or alkylcycloalkyl group containing from 3 to 30 carbons, or a cycloalkyl or heterocycloalkyl group containing from 3 to 30 carbons wherein $R^1$ and $R^2$ are joined in a ring structure with a covalent bond, or by covalent bonding to a common divalent heteroatom of oxygen, sulfur or another tertiary alkyl nitrogen group wherein the degree of substitution can vary from 1 to 18, or 21, or 24 of the hydroxyl groups of the selected cyclodextrin wherein the cyclodextrins are of the formulas

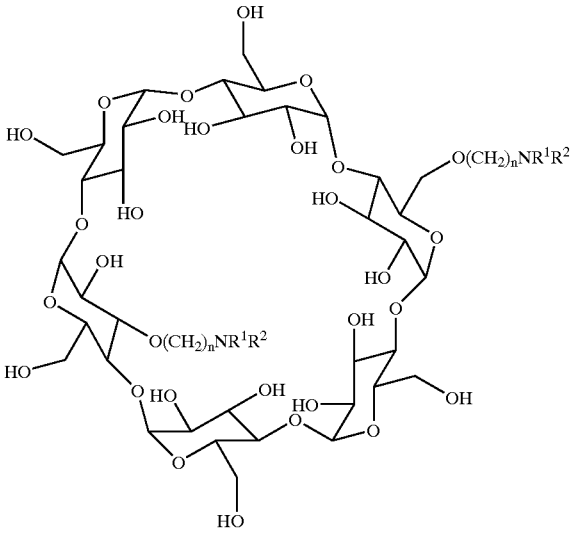

Tertiary Amino Alpha Cyclodextrin;

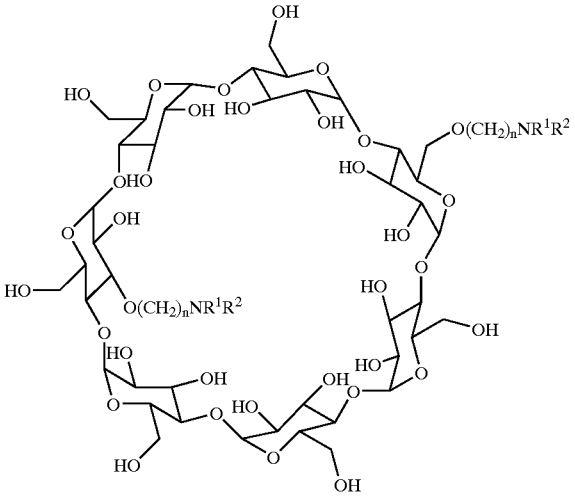

Tertiary Amino Beta Cyclodextrin; or

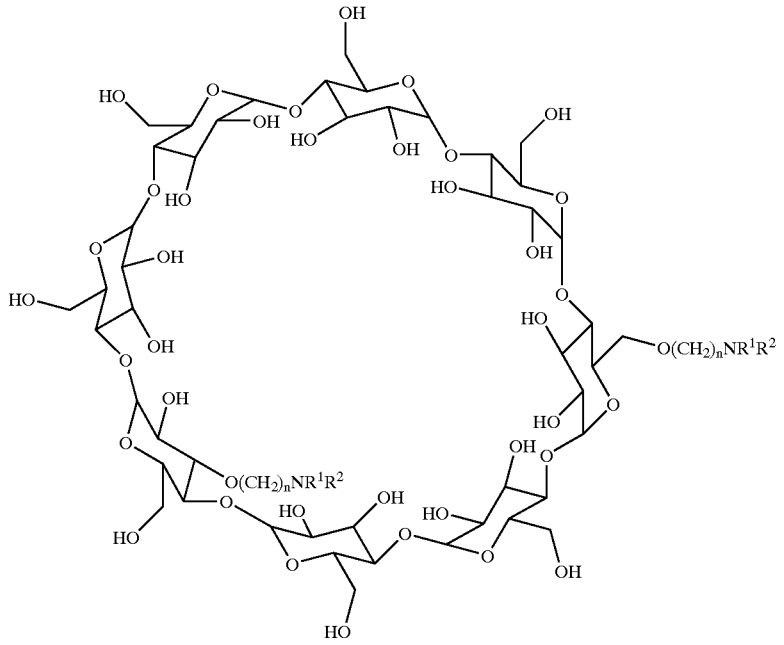

Tertiary Amino Gamma Cyclodextrin; an apparatus wherein the resin is a copolymer of ethylene and vinyl acetate; an apparatus wherein the colorant is present in an amount of from about 0.1 to about 60 percent by weight based on the total weight of the developer solids; an apparatus wherein the charge acceptance agent is present in an amount of from about 0.05 to about 10 weight percent based on the weight of the developer solids of resin, colorant, and charge acceptance agent; an apparatus wherein the cyclodextrin is alpha cyclodextrin; an apparatus wherein the cyclodextrin is beta cyclodextrin, or wherein the cyclodextrin is gamma cylodextrin; an apparatus wherein the cyclodextrin is N,N-diethylamino-N-2-ethyl beta cyclodextrin; an apparatus wherein the liquid for the developer is an aliphatic hydrocarbon; an apparatus wherein the resin is an alkylene polymer, a styrene polymer, an acrylate polymer, a polyester, copolymers thereof, or mixtures thereof, an apparatus wherein the developer is clear in color and contains no colorant; an imaging process wherein images are developed with a liquid developer comprised of resin, optional colorant, nonpolar liquid, and a cyclodextrin charge acceptance compound; a support member including a support surface for supporting a layer of marking material;

a marking material supply apparatus for depositing marking material on the surface of the support member to form the layer of marking material thereon;

a charging source for selectively delivering charge species to the layer of marking material in an imagewise manner to form an electrostatic latent image in the layer of marking material, wherein the electrostatic latent image includes image areas defined by a first charge voltage and nonimage areas defined by a second charge voltage distinguishable from the first charge voltage; and a separator member for selectively separating portions of the marking material layer in accordance with the latent image in the marking material layer to create a developed image; wherein the support member includes a layer of dielectric material; an imaging apparatus wherein the marking material supply apparatus is adapted to deposit a layer of uncharged marking particles on the surface of the support member; an imaging apparatus wherein the marking material supply apparatus is adapted to deposit a layer of electrically charged marking particles on the surface of the support member;

an imaging apparatus wherein the marking material supply apparatus is adapted to deposit a marking material layer having a thickness of about 2 to about 20 microns on the surface of the support member; an imaging apparatus wherein the marking material supply apparatus deposits a marking material layer on the surface of the support member having a thickness in a range between approximately 3 and 8 microns; an imaging apparatus wherein the marking material supply apparatus is adapted to accommodate liquid developing material including marking particles immersed in a liquid carrier medium; an imaging apparatus wherein the marking material supply apparatus is adapted to deposit a marking material layer having a solids percentage by weight of at least approximately 10 percent; an imaging apparatus wherein the marking material supply apparatus is adapted to deposit a marking material layer having a solids percentage by weight in a range between approximately 15 percent and 35 percent; an imaging apparatus wherein the marking material supply apparatus is adapted to supply a marking material layer having a substantially uniform density onto the surface of the support member; an imaging apparatus wherein the marking material supply apparatus includes: a housing adapted to accommodate a supply of marking particles therein; and a rotatably mounted applicator roll member for transporting marking particles from the housing to the surface of the support member; an wherein the marking material supply apparatus further includes an electrical biasing source coupled to the applicator roll for applying an electrical bias thereto to generate electrical fields between the applicator roll and the support member so as to assist in forming the marking material layer on the surface of the support member; an imaging apparatus wherein the marking material supply apparatus includes a fountain-type applicator assembly for transporting a flow of marking particles into contact with the surface of the support member; an imaging apparatus wherein the marking material supply apparatus further includes a metering roll for applying a shear force to the marking material layer on the surface of the support member to control thickness thereof; an imaging apparatus wherein the charging source is adapted for creating an imagewise charge stream directed toward the marking material layer on the support member; an imaging apparatus wherein the charging source includes:

a corona generating electrode for emitting charge species having a predetermined charge polarity; and a charge deposition control device operatively interposed between the corona generating electrode and the support member having the layer of marking material thereon for directing charge species emitted from the corona generating electrode to the layer of marking material; an imaging apparatus wherein the charging source includes a plurality of independent corona generating electrodes and associated charge deposition control devices; an imaging apparatus wherein the plurality of independent corona generating electrodes includes:

a first corona generating electrode for providing charge species of a first charge polarity; and a second corona generating electrode for providing charge species of a second charge polarity; an imaging apparatus wherein the separator member is adapted to attract marking material layer image areas associated with the latent image away from the support member so as to maintain marking material layer nonimage areas associated with the latent image on the surface of the support member;

an imaging apparatus wherein the separator member is adapted to attract marking material layer nonimage areas associated with the latent image away from the support member so as to maintain marking material layer image areas associated with the latent image on the surface of the support member;

an imaging apparatus wherein the separator member includes a peripheral surface for contacting the marking material layer to selectively attract portions thereof away from the support member;

an imaging apparatus wherein the separator member includes an electrical biasing source coupled to the peripheral surface for electrically attracting selectively charged portions of the marking material layer;

an imaging apparatus further including a transfer system for transferring the developed image to a copy substrate to produce an output copy thereof;

an imaging apparatus wherein the transfer system includes a system for substantially simultaneously fixing the image to the copy substrate;

an imaging process, comprising depositing liquid developer particles on a support member to form a developer layer thereon;

selectively delivering charges to the developer layer on the support member in an imagewise manner for forming an electrostatic latent image in the developer layer having image areas defined by a first charge voltage and non-image areas defined by a second charge voltage distinguishable from the first charge voltage; and selectively separating portions of the developer layer from the support member in accordance with the latent image in the developer layer for creating a developed image; and an imaging process wherein the developer depositing step includes depositing a layer of uncharged toner particles on the surface of the support member; and an electrostatographic image development apparatus, comprising:

means for depositing a layer of marking particles on a support member;

means for creating a selective electrical discharge in a vicinity of the layer of marking particles on the support member to selectively charge the layer of marking particles so as to create an electrostatic latent image in the layer of marking particles; and means for selectively separating portions of the layer of marking particles in accordance with the electrostatic latent image for creating a developed image corresponding to the electrostatic latent image formed in the layer of marking particles.

The liquid developer is preferably comprised of an optional liquid, thermoplastic resin, colorant, and a charge acceptance component comprised of a cyclodextrin, wherein the cyclodextrin is comprised of, for example, unsubstituted alpha, beta or gamma cyclodextrin or mixtures thereof of the following formulas

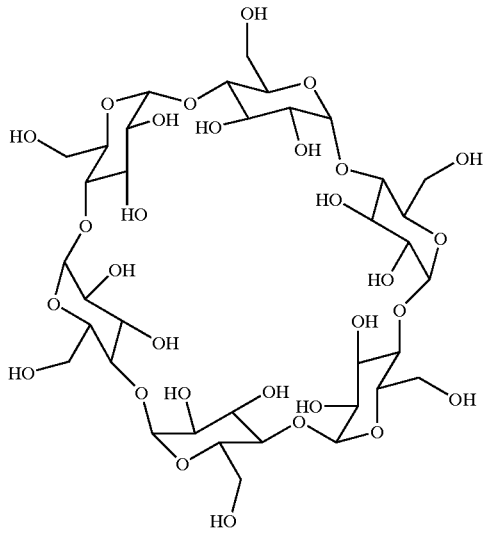

alpha-Cyclodextrin: 6 D-glucose rings containing 18 hydroxyl groups;

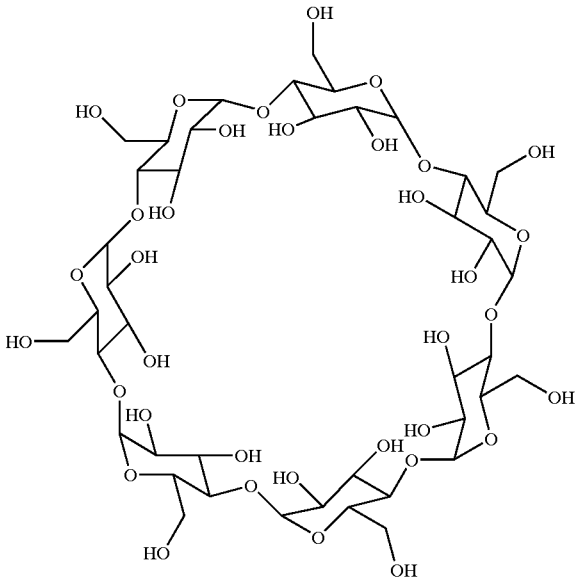

beta-Cyclodextrin: 7 D-glucose rings containing 21 hydroxyl groups; or

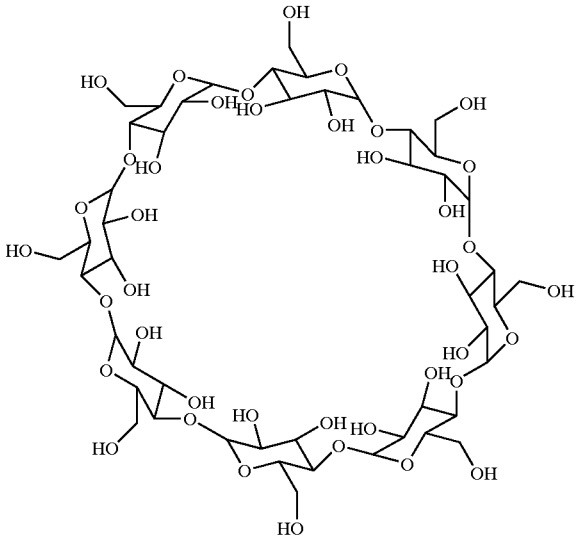

gamma-Cyclodextrin: 8 D-glucose rings containing 24 hydroxyl groups; an apparatus wherein the charge acceptance component is comprised of a tertiary aliphatic amino derivative of alpha, beta or gamma cyclodextrin or mixtures thereof of the following formulas wherein n is an integer of from 2 to 30, and $R^1$ and $R^2$ is an alkyl group containing from 2 to 30 carbons, or an alkylaryl group containing from 7 to 31 carbons, or a cycloalkyl or alkylcycloalkyl group containing from 3 to 30 carbons, or a cycloalkyl or heterocycloalkyl group containing from 3 to 30 carbons wherein $R^1$ and $R^2$ are joined in a ring structure with a covalent bond, or by covalent bonding to a common divalent heteroatom of oxygen, sulfur or another tertiary alkyl nitrogen group wherein the degree of substitution can vary from 1 to 18, or 21, or 24 of the hydroxyl groups of the selected cyclodextrin

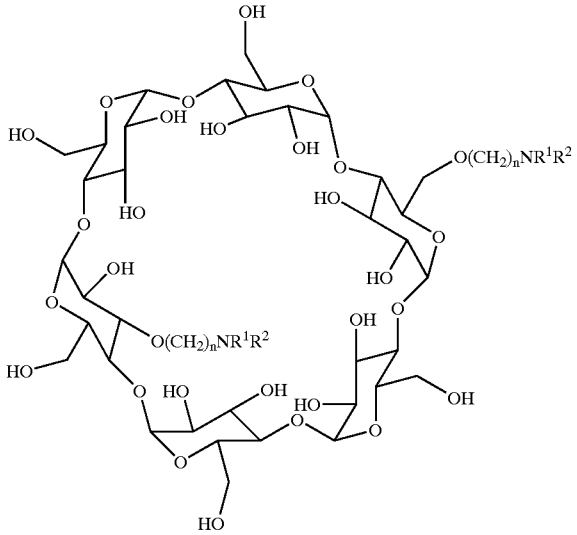

Tertiary Amino Alpha Cyclodextrin;

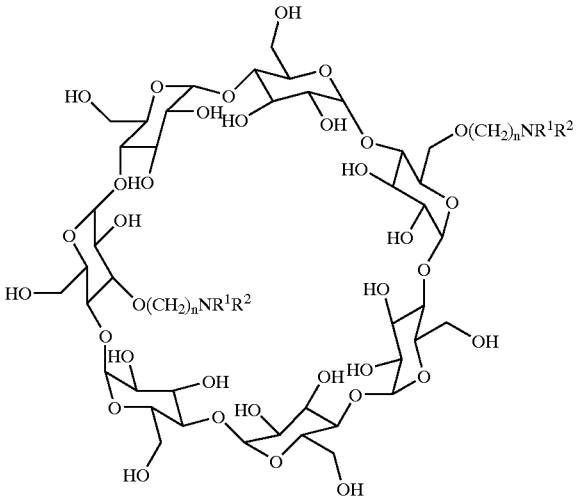

Tertiary Amino Beta Cyclodextrin; or

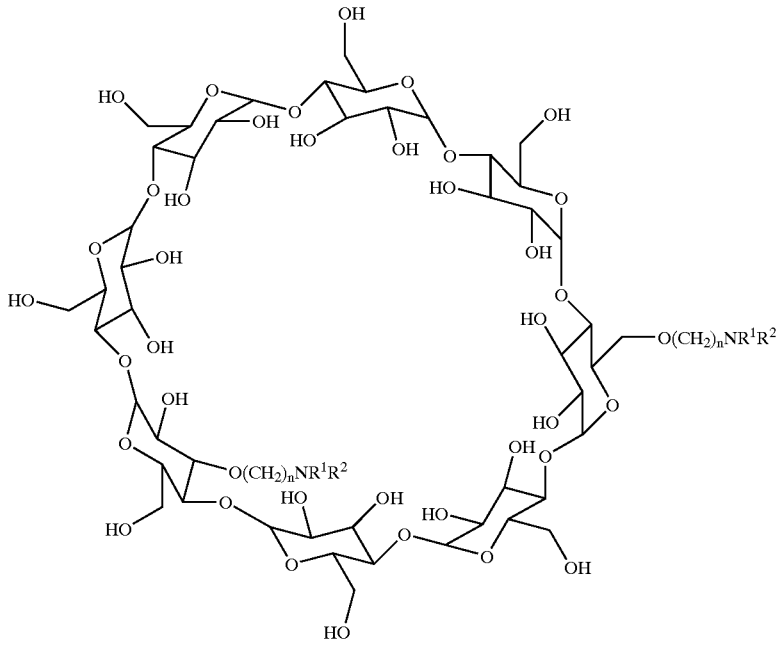
OH
HO
O
OH
HO
OH
O
HO
O
OH
HO
O
OH
HO
O
OH
HO
O
OH
O
HO
O
OH
HO
O
OH
O
HO
O
OH
O
HO
O
OH
O atoms can participate at any given instant in time to complex the positive ion thereby resulting in a sufficient bonding force to acquire permanent positive charging. Optionally, the positive ion from the corona effluent or from species derived therefrom can bind to only one hydroxyl oxygen atom, however, the positive ion can then migrate around all the hydroxyl oxygen atoms surrounding the cyclodextrin cavity opening thereby providing positive charge stability by a charge dispersal mechanism. Also, in the hydroxyl oxygen-positive ion bonding mechanism, the hydroxyl group hydrogen atom is further capable of hydrogen bonding to negative ions originating from the corona effluent or from species derived therefrom. Thus, the hydroxyl group itself is ambivalent in its ability to chemically bind positive and negative ions. In the hydroxyl hydrogen bonding mechanism, hydrogen bonding is an on again-off again mechanism referring, for example, to when one hydrogen bond forms and then breaks there is an adjacent hydroxyl hydrogen atom that replaces the first broken hydrogen bond so that hydrogen bonding charge dispersion occurs to again provide charge stability by a charge dispersal mechanism. In the second mechanism, corona ion fragments (either polarity) or species derived therefrom that are small enough can become physically entrapped inside the cyclodextrin cavity opening resulting in a charged cyclodextrin molecule and hence again a charged toner layer. This ion trapping mechanism is specific to the steric size of the ion or ions emanating from the corona effluent or from species derived therefrom. Ions should be able to fit into the cavity opening to be entrapped, and ions too large cannot enter the cavity opening, will not be entrapped and will not charge the toner layer by this mechanism. Ions that are too small to rapidly pass into and out of the cyclodextrin cavity opening and are not entrapped for a significant time period, will not charge the toner layer by the aforementioned entrapment mechanism. These inappropriately sized ions, however, could ultimately charge the toner layer as indicated herein. Also, some of the corona effluent ions may have first interacted with other toner layer components to produce secondary ions that are captured by the cyclodextrin charge acceptance molecules. However, any secondary ion formation that might occur should not be too extensive to cause a degradation of the polymeric toner resin or the colorant during the toner layer charging, and wherein the toner layer retains its integrity and the colorant its color strength.

With regard to the aluminum salts illustrated herein and the appropriate patents mentioned herein, such as the carboxylate salts selected as charge acceptance components, preferably at least one of the toner resins in the developer contains a functional group capable of covalently bonding to the aluminum charge acceptance agent. Typical functional groups include a carboxylic acid and a hydroxyl group. Examples of resins with functional groups are carboxylic acid containing resins such as the NUCREL resins available from E.I. DuPont. When the carboxylic acid group in the resin forms a covalent bond with the aluminum containing charge acceptance agent, it is believed that the carboxylic acid group anchors the charge acceptance agent to the toner resin in the solid phase. Thus, when the charge acceptance agent accepts an ionic charge from the corona discharge or from species derived therefrom, the ionic charge is also anchored in the solid phase of the liquid toner. Since only toner particles then become charged, the concentration of free mobile ions in the developer liquid phase is avoided or minimized. The avoidance of mobile ions in the liquid phase is desirable since they interfere with BIC-reverse charging development. This type of charge acceptance agent preferentially accepts negative ions, wherein the negative ions frequently contain one or more negative oxygen atoms, to provide a negatively charged liquid developer. The aluminum salts generally accept oxygen nucleophiles (preferentially as a negative oxygen anion) from the corona effluent by forming a fourth covalent bond between the oxygen nucleophile and the aluminum atom, thereby generating a negative aluminum atom which renders the aluminum-containing molecule negatively charged. Acceptance of positive ions, generated from the corona effluent or from species derived therefrom, by an aluminum carboxylate charge acceptor may occur to generate positively charged aluminum containing molecules. Three bonding mechanisms are plausible between positive ions and the aluminum carboxylate charge acceptors and which generate positively charged aluminum containing molecules and a positively charged toner layer. Although not being desired to be limited by theory, (1) a low steady-state concentration of free carboxylate anions, dissociated from the aluminum carboxylate complex but contained therein, could accept positive ions; (2) the aluminum carboxylate complex positive ion acceptance mechanism could also occur by positive ion-hydrogen bonding with water of hydration surrounding the aluminum carboxylate charge acceptor; and (3) the aluminum carboxyiate complex positive ion acceptance mechanism could also be accomplished by positive ion-hydrogen bonding with hydroxyl groups, attached to the aluminum atom in the aluminum carboxylate complex.

While not being desired to be limited by theory, capturing charge using a charge acceptance agent versus a charge control agent is different mechanistically. A first difference resides in the origin and location of the species reacting with a charge acceptance agent versus the origin and location of the species reacting with a charge control agent. The species reacting with a charge acceptance agent originate in the corona effluent, which after impinging on the toner layer, become trapped in the solid phase thereof. The species reacting with a charge control agent, i.e. the charge director originates by purposeful formulation of the charge director into the liquid developer and remains soluble in the liquid phase of the toner layer. Both the charge acceptance agent and the charge control additive or agent (in chemically charged developers) are insoluble in the liquid developer medium and reside on and in the toner particles, however, charge directors used for chemically charged developers, dissolve in the developer medium. A second difference between a charge acceptance agent and a charge director is that charge directors in chemically charged liquid developers charge toner particles to the desired polarity, while at the same time capturing the charge of opposite polarity so that charge neutrality is maintained during this chemical equilibrium process. Charge separation occurs only later when the developer is placed in an electric field during development.

The slightly soluble charge acceptance agent initially resides in the liquid phase but prior to charging the toner layer the charge acceptance agent preferably deposits on the toner particle surfaces. The concentration of charge acceptor in the nonpolar solvent is believed to be close to the charge acceptor insolubility limit at ambient temperature especially in the presence of toner particles. The adsorption affinity between soluble charge acceptor and insoluble toner particles is believed to accelerate charge acceptor adsorption such that charge acceptor insolubility occurs at a lower charge acceptor concentration versus when toner particles are not present. When the insoluble or slightly soluble charge acceptors accept (chemically bind) ions from the impinging corona effluent or from species derived therefrom, there is obtained a net charge on the toner particles in the liquid developer. Since the toner layer contains charge acceptors capable of capturing both positive and negative ions, the net charge on the toner layer is not determined by the charge acceptor but instead is determined by the predominant ion polarity emanating from the corona. Corona effluents rich in positive ions give. rise to charge acceptor capture of more positive ions, and therefore, provide a net positive charge to the toner layer. Corona effluents rich in negative ions give rise to charge acceptor capture of more negative ions, and therefore, provide a net negative charge to the toner layer.

A difference in the charging mechanism of a charge acceptance agent is that after charging a liquid developer via the standard charge director (chemical charging) mechanism, the developer contains an equal number of charges of both polarity. An equal number of charges of both polarities in the developer hinders reverse charge imaging, so adding a charge director to the developer before depositing the uncharged developer onto the dielectric surface is undesirable. However, if corona ions in the absence of a charge director are used to charge the toner layer, the dominant ion polarity in the effluent will be accepted by the toner particles to a greater extent resulting in a net toner charge of the desired polarity and little if any counter-charged particles. When the toner layer on the dielectric receiver has more of one kind (positive or negative) of charge on it, reverse charge imaging is facilitated.

Of importance with respect to the present invention is the presence in the liquid developer of the charge acceptor, for example, the aluminum salts illustrated herein, cyclodextrins, and the like, which agents function to, for example, increase the Q/M of both positive and negatively charged developers. The captured charge can be represented by Q=fCV, where C is the capacitance of the toner layer, V is the measured surface voltage, and f is a proportionality constant which is dependent upon the distribution of captured charge in the toner layer. M in Q/M is the total mass of the toner solids. It is believed that with the developers of the present invention in embodiments all charges are associated with the solid toner particles.

Examples of charge acceptance additives present in various effective amounts of, for example, from about 0.001 to about 10, and preferably from about 0.01 to about 7 weight percent or parts, include cyclodextrins, aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; and bis[tetraalkylated hydroxy naphthoic acid] aluminate wherein alkyl preferably contains 1 to about 6 carbon atoms. Generally, the aluminum complex charge acceptor can be considered a nonpolar liquid insoluble or slightly soluble organic aluminum complex, or mixtures thereof of Formula II, and which additives can be optionally selected in admixtures with those components of Formula I

I

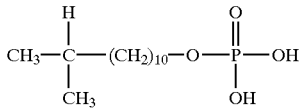

mono

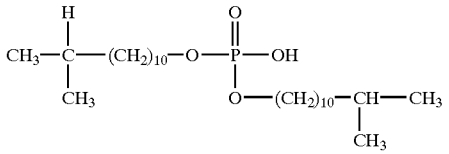

di

II

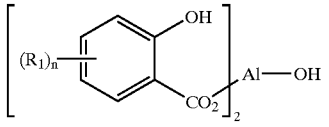

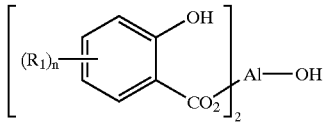

wherein $R_1$ is selected from the group consisting of hydrogen and alkyl, and n represents a number, such as from about 1 to about 4, reference for example U.S. Pat. No. 5,672,456, the disclosure of which is totally incorporated herein by reference.

Cyclodextrins can be considered cyclic carbohydrate molecules comprised, for example, of 6, 7, or 8 glucose units, or segments which represent alpha, beta and gamma cyclodextrins, respectively, configured into a conical molecular structure with a hollow internal cavity. The chemistry of cyclodextrins is described in "*Cyclodextrin Chemistry*" by M. L. Bender and M. Komiyama, 1978, Springer- Verlag., the disclosure of which is totally incorporated herein by reference. The alpha and beta, the preferred cyclodextrin for the liquid developers of the present invention, and gamma cyclodextrins are also known as cyclohexaamylose and cyclomaltohexaose, cycloheptaamylose and cyclomaltoheptaose, and cyclooctaamylose and cyclomaltooctaose, respectively, can be selected as the charge acceptor additives. The hollow interiors provide these cyclic molecules with the ability to complex and contain, or trap a number of molecules or ions, such as positively charged ions like benzene ring containing hydrophobic cations, which insert themselves into the cyclodextrin cavities. In addition, modified cyclodextrins or cyclodextrin derivatives may also be used as the charge acceptance agents for the liquid developer of the present invention. In particular, cyclbdextrin molecular derivatives containing basic organic functional groups, such as amines, amidines and guanidines, also trap protons via the formation of protonated nitrogen cationic species.

Specific examples of cyclodextrins, many of which are available from American Maize Products Company, now Cerestar Inc., include the parent compounds, alpha cyclodextrin, beta cyclodextrin, and gamma cyclodextrin, and branched alpha, beta and gamma cyclodextrins, and substituted alpha, beta and gamma cyclodextrin derivatives having varying degrees of substitution. Alpha, beta and gamma cyclodextrin derivatives include 2-hydroxyethyl cyclodextrin, 2-hydroxypropyl cyclodextrin, acetyl cyclodextrin, methyl cyclodextrin, ethyl cyclodextrin, succinyl beta cyclodextrin, nitrate ester of cyclodextrin, N,N-diethylamino-N-2-ethyl cyclodextrin, N,N-morpholino-N-2-ethyl cyclodextrin, N,N-thiodiethylene-N-2-ethyl-cyclodextrin, and N,N-diethyleneaminomethyl-N-2-ethyl cyclodextrin wherein the degree of substitution can vary from 1 to 18 for alpha cyclodextrin derivatives, 1 to 21 for beta cyclodextrin derivatives, and 1 to 24 for gamma cyclodextrin derivatives. The degree of substitution is the extent to which cyclodextrin hydroxyl hydrogen atoms were substituted by the indicated named substituents in the derivatized cyclodextrins. Mixed cyclodextrin derivatives, containing 2 to 5 different substituents, and from 1 to 99 percent of any one substituent may also be used.

Additional alpha, beta, and gamma cyclodextrin derivatives include those prepared by reacting monochlorotriazinyl-beta-cyclodextrin, available from Wacker-Chemie GmbH as beta W7 MCT and having a degree of substitution of about 2.8, with organic basic compounds such as amines, amidines, and guanidines. Amine intermediates for reaction with the monochlorotriazinyl-beta-cyclodextrin derivative include molecules containing a primary or secondary aliphatic amine site, and a second tertiary aliphatic amine site within the same molecule so that after nucleophilic displacement of the reactive chlorine in the monochlorotriazinyl-beta-cyclodextrin derivative has occurred, the resulting cyclodextrin triazine product retains its free tertiary amine site (for proton acceptance) even though the primary or secondary amine site was consumed in covalent attachment to the triazine ring. In addition, the amine intermediates may be difunctional in primary and/or secondary aliphatic amine sites and mono or multi-functional in tertiary amine sites so that after nucleophilic displacement of the reactive chlorine in the monochlorotriazinyl-beta-cyclodextrin derivative has occurred, polymeric forms of the resulting cyclodextrin triazine product result. Preferred amine intermediates selected to react with the monochlorotriazinyl-beta-cyclodextrin derivative to prepare tertiary amine bearing cyclodextrin derivatives include 4-(2-aminoethyl) morpholine, 4-(3-aminopropyl) morpholine, 1-(2-aminoethyl) piperidine, 1-(3-aminopropyl)-2-piperidine, 1-(2-am inoethyl) pyrrolidine, 2-(2-aminoethyl)-1-methylpyrrolidine, 1-(2-aminoethyl) piperazine, 1-(3-aminopropyl) piperazine, 4-amino-1-benzylpiperidine, 1-benzylpiperazine, 4-piperidinopiperidine, 2-dimethylaminoethyl amine, 1,4-bis(3-aminopropyl) piperazine, 1-(2-aminoethyl)piperazine, 4-(aminomethyl) piperidine, 4,4'-trimethylene dipiperidine, and 4,4'-ethylenedipiperidine. Preferred amidine and guanidine intermediates selected to react with the monochlorotriazinyl-beta-cyclodextrin derivative to prepare amidine and guanidine bearing cyclodextrin triazine CCA products after neutralization include formamidine acetate, formamidine hydrochloride, acetamidine hydrochloride, benzamidine hydrochloride, guanidine hydrochloride, guanidine sulfate, 2-guanidinobenzimidazole, 1-methylguanidine hydrochloride, 1,1-dimethylguanidine sulfate, and 1,1,3,3-tetramethylguanidine. Mixed cyclodextrins derived from the monochlorotriazinyl-beta-cyclodextrin derivative may contain 2 to 5 different substituents, and from 1 to 99 percent of any one substituent in this invention.

Cyclodextrins charge acceptance components include, for example, those of the formulas

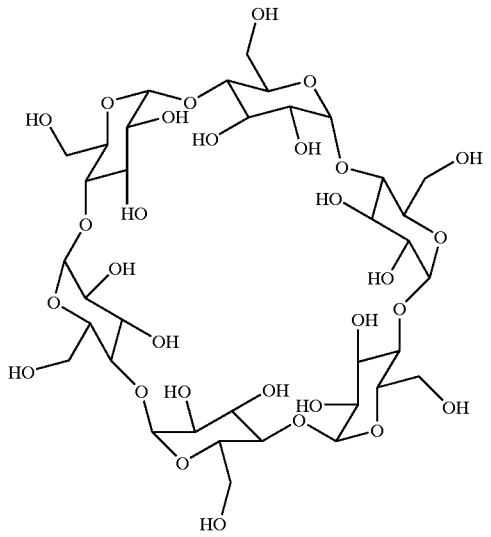

alpha-Cyclodextrin: 6 D-glucose rings containing-18 hydroxyl groups;

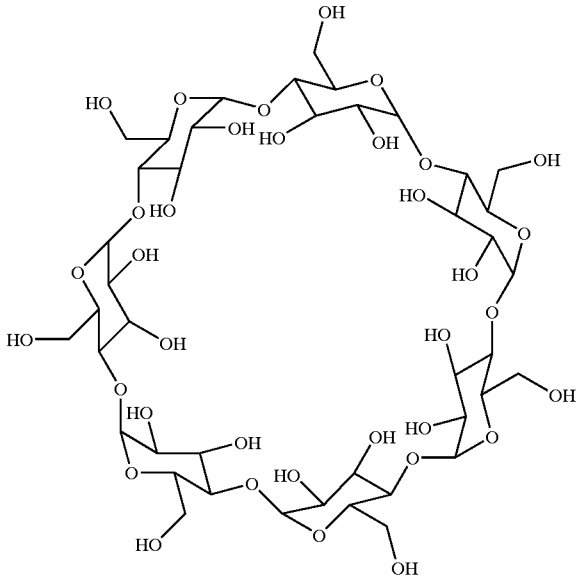
beta-Cyclodextrin: 7 D-glucose rings containing 21 hydroxyl groups;
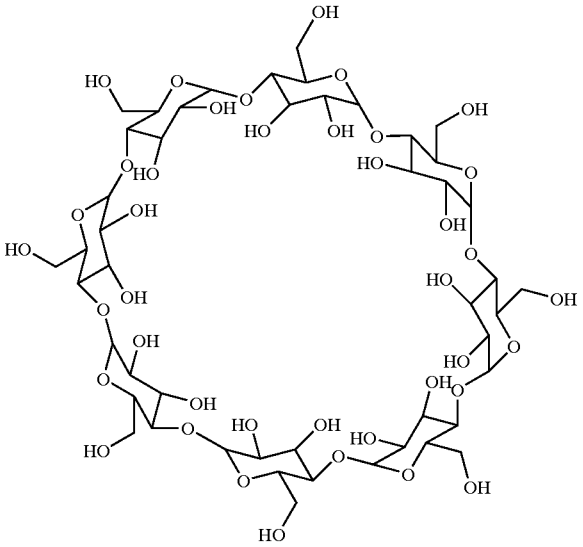
gamma-Cyclodextrin: 8 D-glucose rings containing 24 hydroxyl groups;
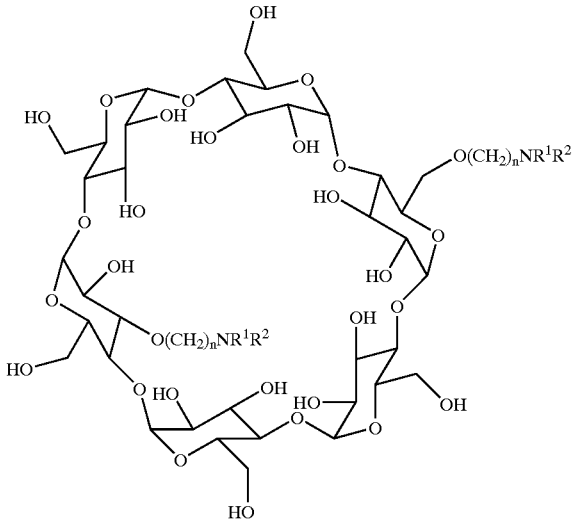
Tertiary Amino Alpha Cyclodextrin;
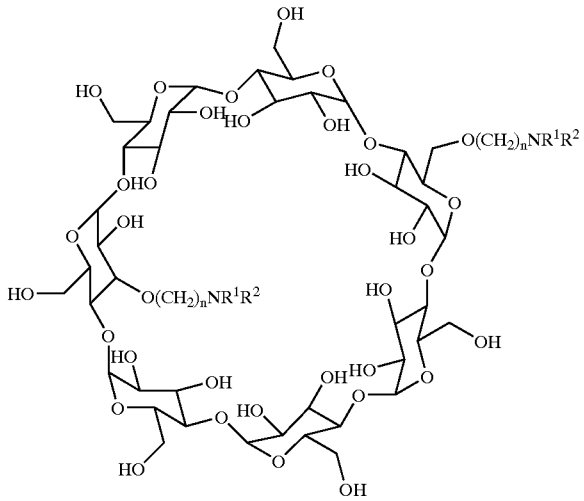
Tertiary Amino Beta Cyclodextrin; and

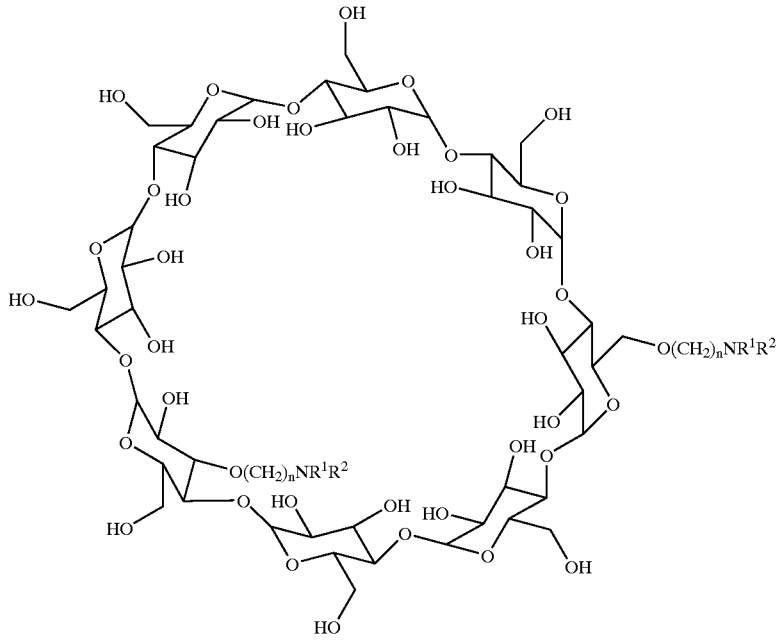

Tertiary Amino Gamma Cyclodextrin.

In embodiments of the present invention, the charge acceptance component or agent, such as the cyclodextrin, is selected in various effective amounts, such as for example from about 0.01 to about 10, and preferably from about 1 to about 7 weight percent based primarily on the total weight percent of the solids, of resin, colorants, and cyclodextrin, or other charge acceptor, and wherein the total of all solids is preferably from about 1 to about 25 percent and the total of nonpolar liquid carrier present is about 75 to about 99 percent based on the weight of the total liquid developer. The toner solids preferably contains in embodiments about 1 to about 7 percent cyclodextrin or aluminum complex, about 15 to about 60 percent colorant, and about 33 to about 83 percent resin, and wherein the total thereof is about 100 percent.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than, for example, $5\times10^{9}$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^{9}$ ohm-centimeters and a dielectric constant below 3 in embodiments of the present invention. Moreover, the vapor pressure at 25° C. should be less than 10 Torr in. embodiments.

While the ISOPAR® series liquids may be the preferred nonpolar liquids for use as dispersant in the liquid developers of the present invention, the important characteristics of viscosity and resistivity may be achievable with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is preferably, for example, from about 80 to about 99 percent, and most preferably from about 85 to about 95 percent by weight of the total liquid developer. The liquid developer is preferably comprised of fine toner particles, or toner solids, and nonpolar liquid. The total solids which include resin, components such as adjuvants, optional colorants, and the cyclodextrin, or aluminum complex charge acceptance agent, content of the developer in embodiments is, for example, 0.1 to 20 percent by weight, preferably from about 3 to about 17 percent, and more preferably, from about 5 to about 15 percent by weight. Dispersion is used to refer to the complete process of incorporating a fine particle into a liquid medium such that the final product consists of fine toner particles distributed throughout the medium. Since liquid developers are comprised of fine particles dispersed in a nonpolar liquid, it is often referred to as dispersion.

Typical suitable thermoplastic toner resins that can be selected for the liquid developers of the present invention in effective amounts, for example, in the range of about 99.9 percent to about 40 percent, and preferably 80 percent to 50 percent of developer solids comprised of thermoplastic resin, charge acceptance component, and in embodiments other component additives Generally, developer solids include the thermoplastic resin, optional charge additive, colorant, and charge acceptance agent. Examples of resins include ethylene vinyl acetate (EVA) copolymers (ELVAX® resins, E.I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL® (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent), and other acrylic resins including ELVACITE® acrylic resins (E.I. DuPont de Nemours and Company); or blends thereof.

The liquid developers of the present invention preferably contain a colorant dispersed in the resin particles. Colorants, such as pigments or dyes and mixtures thereof, may be present to render a latent image visible.

The colorant may be present in the developer in an effective amount of, for example, from about 0.1 to about 60 percent, and preferably from about 15 to about 60, and in embodiments about 25 to about 45 percent by weight based on the total weight of solids contained in the developer. The amount of colorant used may vary depending on the use of the developer. Examples of pigments which may be selected include carbon blacks available from, for example, Cabot Corporation, FANAL PINK®, PV FAST BLUE®, those pigments as illustrated in U.S. Pat. No. 5,223,368, the disclosure of which is totally incorporated herein by reference; other known pigments; and the like. Dyes are known and include food dyes.

To further increase the toner particle charge and, accordingly, increase the transfer latitude of the toner particles, charge adjuvants can be added to the developer. For example, adjuvants, such as metallic soaps like magnesium stearate or octoate, fine particle size oxides, such as oxides of silica, alumina, titania, and the like, paratoluene sulfonic acid, and polyphosphoric acid, may be added. These types of adjuvants can assist in enabling improved toner charging characteristics, namely, an increase in particle charge that results in improved image development and transfer to allow superior image quality with improved solid area coverage and resolution in embodiments. The adjuvants can be added to the developer in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, charge acceptance component, optional charge additives, such as charge adjuvants, and colorant in a manner that the resulting mixture contains, for.example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight solids and isolating the developer by, for example, cooling the dispersion to about 10° C. to about 30° C. In the initial mixture, the resin, charge acceptance component, and optional colorant may be added separately to an appropriate vessel, such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60, and more specifically, from about 35 to about 45 percent solids. This mixture is then subjected to elevated temperatures during the initial mixing procedure to plasticize and soften the resin. Thereafter, the mixture is sufficiently heated to provide a uniform dispersion of all the solid materials of, for example, colorant, cyclodextrin or aluminum complex charge acceptance component, and resin. The temperature should not be high where degradation of the nonpolar liquid or decomposition of the resin or colorant occurs. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the resulting dispersion. The amount of nonpolar liquid added should be sufficient in embodiments preferably to decrease the total solids concentration of the dispersion to about 10 to about 30 percent by weight.

The dispersion is then cooled, for example, to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods, such as the use of a cooling fluid like water, glycols such as ethylene glycol, in a jacket surrounding the mixing vessel. More specifically, cooling can be accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to about 36 hours, and preferably from about 2 to about 4 hours. Additional liquid may be added during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

Embodiments of the invention will be illustrated in the following nonlimiting Examples, it being understood that these Examples are intended to be illustrative only, and that the invention is not intended to be limited to the materials, conditions, process parameters and the like recited. The toner particles or solids in the liquid developer can range in diameter size of from about 0.1 to about 3 micrometers with a preferred particle size range being about 0.5 to about 1.5 micrometers. Particle size, when measured, was determined by a Horiba CAPA-700 centrifugal automatic particle analyzer manufactured by Horiba Instruments, Inc., Irvine, Calif. Comparative Examples and data are also provided.

CHARGING CURRENT TEST

Charging Current Test For Embodiments Using Cyclodextrins as Charge Acceptance Agents:

An experimental setup for accomplishing a charging current test is illustrated in FIG. 1 of copending application U.S. Ser. No. 09/492,715, the disclosure of which is totally incorporated herein by reference. A thin (5 to 25 micrometers) liquid toner layer 5 is prepared on a flat conductive plate 6. The plate is grounded through a meter 7. The charging wire of the scorotron is represented by 1, the scorotron grid by 3, ions by 4, ground by 8, and electrostatic voltmeter by 10 with DC representing direct current. A charging device, such as a scorotron 2, is placed above the plate. With no toner layer on the plate (bare plate), the current that passes through the plate to the ground is a constant ($I_b$) during charging. Assuming a toner layer is a pure insulator, the current passing from the plate to the ground is zero during charging. By monitoring the current that passes through the plate to ground, the toner charge capture or acceptance ability can be measured. The closer the steady state current is to zero, the more charge the toner layer has captured or accepted. The closer the steady state current is to the bare plate current $I_b$, the less charge the toner layer has captured or accepted. The faster the current reaches its steady state, the higher is the toner charge capturing or accepting efficiency. One way to analyze the experimental data is to calculate the absolute current difference of a toner layer on the plate and a bare plate. The larger the current difference, the more charge the toner layer has captured or accepted.

CHARGING VOLTAGE TEST

Charging Voltage Test For Embodiments Usinq Cyclodextrins as Charge Acceptance Agents:

An experimental setup for a charging voltage test is similar to the one illustrated in FIG. 1 except that a meter 7 is not required. A thin (5 to 25 micrometers) liquid toner layer is prepared on a flat conductive plate. A scorotron is placed above the sample plate. When the scorotron is turned off, the charged toner layer on the plate is instantly moved to an immediately adjacent location underneath the electrostatic voltmeter (ESV) in order to measure the surface voltage. The ESV 10 is located about 1 to about 2 millimeters above the charged toner layer. A typical test involves first charging the toner layer with a scorotron for 0.5 second, and then monitoring the surface voltage decay as a function of time for two minutes. This is accomplished for both positively and negatively charged toner layers.

EXAMPLES

Control 1 in Tables 1 and 2=40 Percent of PV FAST BLUE®; 5 percent Cvclodextrin; Alohas Charge Director Concentration=1 mg/g solids:

One hundred forty-eight point five (148.5) grams of ELVAX 200W® (a copolymer of ethylene and vinyl acetate with a melt index at 190° C. of 2,500, available from E.I. DuPont de Nemours & Company, Wilmington, Del.), 108.0 grams of the cyan pigment (PV FAST BLUE B2GA® obtained from Clarient), 13.5 grams of beta cyclodextrin also known as cycloheptaamylose or cyclomaltoheptaose obtained from Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 56° C. to 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

To a one-hundred gram sample of the above toner discharged from attritor (11.549 percent solids) was added 0.385 gram of Alohas charge director (3 weight percent in ISOPAR-M®) to provide a charge director level of 1 milligram of charge director per gram of toner solids.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

The resulting chemical charged liquid developer was comprised of toner solids containing 55 percent resin, 40 percent pigment, 5 percent cyclodextrin charge control additive (percent by weight throughout based on the total toner solids), ISOPAR-M®, and Alohas charge director, 3 weight percent, which chemically charges the toner positively.

Control 2 in Tables 1 and 2=40 Percent of PV FAST BLUE®; 5 Percent Cyclodextrin; Alohas Charge Director Concentration=2 mq/q solids:

One hundred forty-eight point five (148.5) grams of ELVAX 200W® (a copolymer of ethylene and vinyl acetate with a melt index at 190° C. of 2,500, available from E.I. DuPont de Nemours & Company, Wilmington, Del.), 108 grams of the cyan pigment (PV FAST BLUE B2GA® obtained from Clarient), 13.5 grams of the above beta cyclodextrin (cyclodextrin obtained by Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor which was heated with running steam through the attritor jacket at about 56° C. to about 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

To a one hundred gram sample of the mixture (11.549 percent solids) was added 0.770 gram of Alohas charge director (3 weight percent in ISOPAR-M®) to provide a charge director level of 2 milligrams of charge director per gram of toner solids.

Alohas is an abbreviated name for hydroxy bis(3,5-di-tertiary butyl salicylic) aluminate monohydrate, reference for example U.S. Pat. Nos. 5,366,840 and 5,324,613, the disclosures of which are totally incorporated herein by reference.

The resulting liquid developer was comprised of toner solids containing 55 percent resin, 40 percent pigment, 5 percent cyclodextrin charge control additive (based on the total toner solids), ISOPAR-M®, and Alohas charge director which chemically charges the toner positively. This developer is a chemically charged liquid developer composition. Example 1 in Tables 1 and 2=40 Percent of PV FAST BLUE®; 5 Percent Cyclodextrin; No Alohas Added One hundred forty-eight point five (148.5) grams of ELVAX 200W® (a copolymer of ethylene and vinyl acetate with a melt index at 190° C. of 2,500, available from E.I. DuPont de Nemours & Company, Wilmington, Del.), 108 grams of the cyan pigment (PV FAST BLUE B2GA® obtained from Clarient), 13.5 grams of the above beta cyclodextrin (cyclodextrin obtained by Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor, which was heated with running steam through the attritor jacket at about 56° C. to about 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

The liquid developer was used as is from the attritor (11.549 percent solids).

The resulting liquid developer was comprised of toner solids containing 55 percent resin, 40 percent pigment, 5 percent cyclodextrin charge acceptance additive (percent by weight throughout based on the total toner solids), and ISOPAR-M®. This developer is considered an ion-charged liquid developer composition.

CHARGING CURRENT TEST RESULTS

Tables 1 and 2 contain the charging current test results. Table 1 lists the raw data readings and Table 2 lists the after process data. The following discussion and numbers refer to Table 2. The charging current test experimental setup is illustrated in FIG. 1 of the copending application U.S. Ser. No. 09/492,715. When Alohas charge director is not added to the liquid toner formulation, the charging current difference with a bare plate in Example 1 (Table 2) indicates that after first charging the toner layer positive and then reversing to negative, the positive current difference is 0.15 $\mu$A and the reverse negative current difference is 0.14 $\mu$A. This result indicates that when using cyclodextrin as the charge acceptance agent without Alohas charge director present the charging polarity can be reversed to about the same levels. In controls 1 and 2 of Table 2, in which 1 milligram and 2 milligrams of Alohas charge director per gram of toner solids were used, respectively, reversing the charging polarity from positive to negative provided small current difference values (0.04 and 0.05 $\mu$A) which indicates that the toner layer resisted being charged to a negative polarity. It is believed that the soluble Alohas charge director captures negative charge, and that the captured negative charge immediately migrates to ground in the liquid phase leaving very little negative charge remaining on the toner particles in the solid phase.

When Alohas charge director is not added to the liquid toner formulation, the charging current difference with a bare plate in Example I (Table 2) indicates that after first charging the toner layer negative and then reversing to positive, the negative current difference is 0.18 $\mu$A and the reverse positive current difference is 0.15 $\mu$A. This result indicates that when using cyclodextrin as the charge acceptance agent without Alohas charge director present, the charging polarity can be easily reversed to about the same levels. In controls 1 and 2 of Table 2, in which 1 milligram and 2 milligrams of Alohas charge director per gram of toner solids were used, respectively, reversing the charging polarity from negative to positive again provided small current difference values (0.04 and 0.05 $\mu$A) which indicates that the toner layer resisted being charged to a positive polarity.

TABLE 1

| | Ink Composition | | | | | Charging Current Test Results | | | |
|---|---|---|---|---|---|---|---|---|---|
| | | | | | | Positive then Negative | | Negative then Positive | |
| | Solid Phase | | | Liquid Phase | | current of positive charging at 1 second* | current of negative charging at 1 second** | current of negative charging at 1 second* | current of positive charging at 1 second** |
| | Resin | Pigment | Charge acceptor | Carrier fluid | Charge director | | | | |
| Control 1 (A typical LID ink) | 55% Elvax 200 W | 40% PVFB | 5% cyclo-dextrin | Isopar M | 1:1 Alohas | 0.35 | −0.56 | −0.55 | 0.45 |
| Control 2 (A typical LID ink) | 55% Elvax 200 W | 40% PVFB | 5% cyclo-dextrin | Isopar M | 2:1 Alohas | 0.35 | −0.55 | −0.56 | 0.45 |
| Example I | 55% Elvax 200 W | 40% PVFB | 5% cyclo-dextrin | Isopar M | No | 0.35 | −0.46 | −0.42 | 0.35 |

*The positive current that passed through a bare plate was 0.5 $\mu$A

**The negative current that passed through a bare plate was −0.6 $\mu$A

TABLE 2

| | Ink Composition | | | | | Charging Current Test Results | | | |
|---|---|---|---|---|---|---|---|---|---|
| | | | | | | Positive then Negative | | Negative then Positive | |
| | Solid Phase | | | Liquid Phase | | current difference* of positive charging at 1 second | current difference* of negative charging at 1 second | current difference* of negative charging at 1 second | current difference* of positive charging at 1 second |
| | Resin | Pigment | Charge acceptor | Carrier fluid | Charge director | | | | |
| Control 1 (A typical LID ink) | 55% Elvax 200 W | 40% PVFB | 5% cyclo-dextrin | Isopar M | 1:1 Alohas | 0.15 | 0.04 | 0.05 | 0.05 |
| Control 2 (A typical LID ink) | 55% Elvax 200 W | 40% PVFB | 5% cyclo-dextrin | Isopar M | 2:1 Alohas | 0.15 | 0.05 | 0.04 | 0.05 |
| Example I | 55% Elvax 200 W | 40% PVFB | 5% cyclo-dextrin | Isopar M | No | 0.15 | 0.14 | 0.18 | 0.15 |

*current difference = $II_t$ to $I_bI$, where $I_t$ is the current that passes through the plate 6 (to ground) on which a toner layer is located; $I_b$ is the current that passes through the bare plate to ground.

Control in Table 3=100 Percent of DuPont ELVAX 200®; No Charge Acceptance Agent

Two hundred and seventy (270) grams of ELVAX 200W® (a copolymer of ethylene and vinyl acetate resin with a melt index at 190° C. of 2,500, available from E.I. DuPont de Nemours & Company, Wilmington, Del.), and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at about 56° C. to about 115° C. for 2 hours. 675 Grams of ISOPAR-G® were added to the attritor, and cooled to 23° C. by running water through the attritor. jacket, and the contents of the attritor were ground for 2 hours. Additional ISOPAR-G®, about 900 grams, was added and the mixture was separated from the steel balls.

The liquid developer, which was used as is from the attritor, was comprised of 11.779 percent toner solids (100 percent resin), and 88.221 percent ISOPAR®.

EXAMPLE I

In Table 3=99 Percent of DuPont ELVAX 200W®; 1 Percent Tertiary Amine β-Cyclodextrin Two hundred and sixty-seven point three (267.3) grams of ELVAX 200W® (a copolymer of ethylene and vinyl acetate with a melt index at 190° C. of 2,500, available from E.I. DuPont de Nemours & Company, Wilmington, Del.), 2.7 grams of tertiary amine β-cyclodextrin (available from Cerestar, Inc., Hammond, Ind.) and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at about 56° C. to about 115° C. for 2 hours. 675 Grams of ISOPAR-G® were added to the attritor, and cooled to 23° C. by running water through the attritor jacket, and the contents of the attritor were ground for 2 hours. Additional ISOPAR-G®, about 900 grams, was added and the mixture was separated from the steel balls.

Liquid developer, which was used as is from the attritor (11.701 percent solids based on the total of the liquid developer), was comprised of toner solids, which contained 99 percent of the above ELVAX® resin and charge acceptor of 1 percent tertiary amine β-cyclodextrin (based on total toner solids), and 88.299 percent ISOPAR®.

EXAMPLE II

In Table 3=95 Percent of DuPont ELVAX 200W®; 5 Percent Tertiary Amine β-Cyclodextrin Two hundred and fifty-six (256) grams of ELVAX 200W® (a copolymer of ethylene and vinyl acetate with a melt index at 190° C. of 2,500, available from E.I. DuPont de Nemours & Company, Wilmington, Del.), 13.5 grams of tertiary amine β-cyclodextrin (available from Cerestar, Inc., Hammond, Ind.) and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture resulting was milled in the attritor which was heated with running steam through the attritor jacket at about 56° C. to about 115° C. for 2 hours. 675 Grams of ISOPAR-G® were added to the attritor, and cooled to 23° C. by running water through the attritor jacket, and the contents of the attritor were ground for 2 hours. Additional ISOPAR-G®, about 900 grams, was added and the mixture was separated from the steel balls.

Liquid developer, which was used as is from the attritor, (11.463 percent solids), was comprised of 11.463 percent toner solids containing 95 percent resin and 5 percent cyclodextrin charge acceptance additive based on total toner solids, and 88.537 percent ISOPAR-M®.

CHARGING VOLTAGE TEST RESULTS

To better understand the effect of the charge acceptor on reverse charging, the toner layer surface-charging voltage test illustrated herein can be selected.

TABLE 3

| | Ink Composition | | | | | Test Results | | | |
|---|---|---|---|---|---|---|---|---|---|
| | | | | | | Positive | | Negative | |
| | Solid Phase | | | Liquid Phase | | Initial | Surface Voltage | Initial | Surface Voltage |
| | Resin | Pigment | Charge acceptor | Carrier fluid | Charge director | surface voltage | after 5 seconds | surface voltage | after 5 seconds |
| Control | 100% Elvax 200 W | No | No | Isopar M | No | 10 | 2 | −11 | −10 |
| Example I | 99% Elvax 200 W | No | 1% cyclo-dextrin | Isopar M | No | 12 | 8 | −16 | −15 |
| Example II | 95% Elvax 200 W | No | 5% cylco-dextrin | Isopar M | No | 22 | 15 | −22 | −18 |

Ink (toner) layers with thickness of 15 $\mu$m were generated by draw bar coating. Scorotrons were used as the charging and recharging devices.

The positive and negative toner layer charge-capturing propensity can be measured by several techniques. One frequently used technique involves first charging the toner layer with a scorotron for a fixed time, e.g. 2 seconds, and then monitoring the surface voltage decay as a function of time when charging is avoided or turned off. This is accomplished for both positively and negatively charged toner layers.

The data in the control of Table 3 indicates that the ink layer with no charge acceptor captured or accepted negative charge equivalent to a surface voltage of −11 volts and maintained −10 volts thereof for 5 seconds. However, the same ink layer, when charged positively, captured or accepted +10 volts initially, but then the voltage of this control ink layer decayed rapidly to 2 volts in 5 seconds.

The data in Example I of Table 3, wherein 1 percent tertiary amine cyclodextrin was used as the charge acceptance agent, indicates that the ink layer, when charged negatively, captured or accepted negative charge equivalent to a surface voltage of −16 volts and maintained −15 volts thereof for 5 seconds. However, when charged positively, the same ink layer captured or accepted +12 volts and decayed slowly to 8 volts in 5 seconds. When charged negatively, the ink layer containing the 1 percent cyclodextrin charge acceptance agent improved (versus the control without cyclodextrin) in negative charging level from −11 volts to −16 volts (145 percent improvement). Comparing the decay for the 5 second negative surface voltage in Example I versus the Control indicated that in Example I the 5 second negative surface voltage was −15 volts (50 percent improvement) whereas in the Control the 5 second negative surface voltage was only −10 volts. When charged positively, the ink layer containing the 1 percent cyclodextrin charge acceptance agent improved in positive charging level from +10 volts to +12 volts (120 percent improvement). Comparing the decay for the 5 second positive surface voltage in Example I versus the Control indicated that in Example I the 5 second positive surface voltage was +8 volts (400 percent improvement) whereas in the Control the 5 second positive surface voltage was only +2 volts.

The data in Example 2 of Table 3, wherein 5 percent tertiary amine cyclodextrin was used as the charge acceptance agent, indicates that the ink layer, when charged negatively, captured or accepted negative charge equivalent to a surface voltage of −22 volts and maintained −18 volts thereof for 5 seconds. However, when charged positively, the same ink layer captured or accepted +22 volts and decayed slowly to 15 volts in 5 seconds. When charged negatively, the ink layer containing the 5 percent cyclodextrin charge acceptance agent improved (versus the control without cyclodextrin) in negative charging level from −11 volts to −22 volts (200 percent improvement). Comparing the decay for the 5 second negative surface voltage in Example II versus the Control indicated that in Example II the 5 second negative surface voltage was −18 volts (180 percent improvement) whereas in the Control the 5 second negative surface voltage was only −10 volts. When charged positively, the ink layer containing the 5 percent cyclodextrin charge acceptance agent improved in positive charging level from +10 volts (control without cyclodextrin) to +22 volts (220 percent improvement). Comparing the decay for the 5 second positive surface voltage in Example II versus the Control indicated that in Example II the 5 second positive surface voltage was +15 volts (750 percent improvement) whereas in the Control the 5 second positive surface voltage was only +2 volts.

The following ICEP print tests were used for the liquid developers containing, for example, aluminum carboxylate complexes (such as Alohas) as charge acceptance agents:

ICEP BENCH PRINT TEST

Four Options for Using the Bench Print Test:

Ionographic Contact Electrostatic Printing (ICEP) development is initiated with a uniform uncharged toner layer. A first charging device charges toner to a first polarity, then an ionographic printing head reverses the toner charge to a second polarity in an imagewise fashion. A biased Image Bearer (IB) subsequently separates the image from the background corresponding to the charge pattern in the toner layer. Thus, the toner image is formed on the IB and is ready to be transferred to final substrates. Since the toner layer resided on a conductive or semi-conductive layer, the first polarity can be either positive or negative. Table 4 summarizes the four process options in ICEP development. An objective of the bench print test for ICEP is to identify the optimized process parameters for each ink by acquiring four development curves for all the process options. From each print test, the expemost desired outputs maximum ROD (ROD>1.3) in solid area minimum ROD (background ROD <0.15) in background area, and excellent solid area image quality. (Delta E=the square root of sum of squares of L*, a*, and b* less than 2 for both microscopic and macroscopic uniformity).

TABLE 4

ICEP Print Test Options

| Development Options | Charge Entire Toner Layer to a First Polarity | Charge Selected Area of Toner Layer to a Second Polarity | IB Bias Polarity |
|---|---|---|---|
| (−,+,−) | − | + | − |
| (−,+,+) | − | + | + |
| (+,−,+) | + | − | + |
| (+,−,−) | + | − | − |

In the first print test option in Table 4 above, the entire toner layer on the conductive or semi-conductive surface is first charged negative, and then only the imaged area charge is reversed to positive by an ionographic printing head, and finally the image bearer (IB) biased to a negative polarity transfers the imaged area to itself. In the second print test option in Table 4, the entire toner layer on the conductive or semiconductive surface is first charged negative, and then only the background area charge is reversed to positive, and finally the image bearing member (IB) biased to a positive polarity transfers the imaged area to itself. In the third print test option in Table 4, the entire toner layer on the conductive or semiconductive surface is first charged positive, and then only the imaged area charge is reversed to negative, and finally the image bearing member (IB) biased to a positive polarity transfers the imaged area to itself. The first and third options are the same except that the charge polarities are reversed at each stage. In the fourth print test option in Table 4, the entire toner layer on the conductive or semiconductive surface is first charged positive, and then only the background area charge is reversed to negative, and finally the image bearing member (IB) biased to a negative polarity transfers the imaged area to itself. The second and fourth options are the same except that the charge polarities are reversed at each stage.

In FIG. 2 of copending application U.S. Ser. No. 09/492,715, 5 represents positively charged toner particles on a conductive or semiconductive surface 6; 3C represents ions from a ionographic writing head; 2A is a charging scorotron; 12 is a biased conditioning roll which functions to remove some liquid from the toner layer without changing charge polarity or charge level; 2B an ionographic writing head which recharge toner selectively to negative polarity; 14 is a biased image bearer roll; 3A represents the scorotron grid; 1A represents charging wires of the scorotron; V1 is equal to 5,800 volts; cake charging is accomplished by the ions from the charging device 2A; cake conditioning refers to increasing the solids content of the positively charged toner layer from about 5 to about 15 percent to about 20 to about 22 percent, and wherein there is selected for this conditioning a positively charged squegee roll or image conditioning roll; recharging refers to the imagewise recharging of the toner layer, which recharging is accomplished with a ionographic writing head 2B, and wherein the polarity is negative; cake and cake pickup refers to the cake comprised of nonpolar liquid or carrier fluid, toner particles or solids of resin, charge acceptance component and colorant, 20 to 22 percent solids, and wherein the cake is picked up or developed by the positively charged 1B roll or image bearer roll 14.

In this ICEP bench experiment, a draw bar coating device was used to coat a thin uniform toner layer onto the conductive or semiconductive substrate using an ink containing 10 to 15 weight percent solids. One scorotron was used to charge the toner layer and a biased metal roll was wrapped with Rexham 6262 dielectric paper with the rough side contacting the toner layer to function as the cake conditioning device (CC). An ionographic writing head providing negative ions selectively recharges the toner layer to negative polarity. Another biased metal roll, wrapped with the smooth side of the Rexham 6262 paper, contacted the toner layer to function as the image bearer (IB). FIG. 2 illustrates the experimental steps for (+,−,+) ICEP development.

EXAMPLES FOR ALOHAS

Example=40 Percent of Rhodamine Y Magenta Pigment; 0.7 Percent Alohas Charge Acceptance Agent Bound to Toner Resin:

One hundred sixty point four (160.4) grams of NUCREL RX-76® (a copolymer of ethylene and methacrylic acid with a melt index of about 800, available from E.I. DuPont de Nemours & Company, Wilmington, Del.), 2 grams of Alohas powder and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to about 80° C. to about 115° C. for 2 hours. Next, .107.6 grams of the magenta pigment (Sun Rhodamine Y 18:3 obtained from Sun Chemicals) were added to the attritor. The mixture resulting was milled in the attritor, which was maintained at about 80° C. to about 115° C. for 2 hours with running steam through the attritor jacket. 675 Grams of ISOPAR-M® were added to the attritor at the conclusion of 4 hours, and cooled to 23° C. by running water through the attritor jacket, and the contents of the attritor were ground for an additional 4 hours. Additional ISOPAR-M®, about 600 grams, was added, and the mixture was separated from the steel balls.

The liquid developer solids contained 40 percent by weight of Rhodamine Y magenta pigment, 0.7 percent Alohas as a charge acceptance agent bound to the toner resin, and 59.3 percent NUCREL RX-76® toner resin. The solids level was 11.841 percent and the ISOPAR-M® level was 88.159 percent of this liquid developer.

32.438 Grams of ISOPAR-M® were added to 67.562 grams of the above sample mixture (11.841 percent solids) to generate an ink of 8 percent solids of the above resin, colorant, and Alohas charge acceptance agent, and 92 percent ISOPAR-M®.

The 8 percent solids ink was used for ICEP test. The (+.−,+) ICEP mode in Table 4 was chosen for the print test and the resulting solid area ROD was 1.46 and the background ROD was 0.07.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging apparatus comprising a support member including a support surface for supporting a layer of marking material;

a marking material supply apparatus for depositing marking material on the surface of said support member to form a layer of marking material thereon;

a charging source for selectively delivering charge species to the layer of marking material in an imagewise manner to form an electrostatic latent image in the layer of marking material, wherein the electrostatic latent image includes image areas of a first charge voltage and nonimage areas of a second charge voltage distinguishable from the first charge voltage; and a separator member for selectively separating portions of the marking material layer in accordance with the latent image in the marking material layer to create a developed image and wherein the marking material is comprised of a liquid developer comprised of a nonpolar liquid, resin, colorant, and a charge acceptance component comprised of a cyclodextrin; and wherein said cyclodextrin captures negative ions or positive ions thereby enabling a negatively charged liquid developer or a positively charged liquid developer, respectively.

2. An imaging apparatus in accordance with claim 1 wherein said support member includes a layer of dielectric material, wherein said marking material supply apparatus is adapted to deposit a layer of uncharged marking particles on the surface of said support member, or wherein said marking material supply apparatus is adapted to deposit a layer of electrically charged marking particles on the surface of said support member.

3. An imaging apparatus in accordance with claim 1 wherein said marking material supply apparatus is adapted to deposit a marking material layer having a solids percentage by weight in a range of between about 15 percent and about 35 percent, and wherein said marking material supply apparatus is adapted to supply a marking material layer having a substantially uniform density onto the surface of the support member.

4. An imaging apparatus in accordance with claim 1 wherein said marking material supply apparatus includes:

a housing adapted to accommodate a supply of marking particles therein; and a rotatably mounted applicator roll member for transporting marking particles from said housing to the surface of said support member.

5. An imaging apparatus in accordance with claim 4 wherein said marking material supply apparatus further includes an electrical biasing source coupled to said applicator roll for applying an electrical bias thereto to generate electrical fields between said applicator roll and said support member so as to assist in forming the marking material layer on the surface of said support member.

6. An imaging apparatus in accordance with claim 1 wherein said marking material supply apparatus includes a fountain-type applicator assembly for transporting a flow of marking particles into contact with the surface of said support member, and wherein said marking material supply apparatus optionally further includes a metering roll for applying a shear force to the marking material layer on the surface of said support member to control thickness thereof.

7. An imaging apparatus in accordance with claim 1 wherein said charging source includes a corona generating electrode: for emitting charge species having a predetermined charge polarity; and a charge deposition control device operatively interposed between said corona generating electrode and said support member having the layer of marking material thereon for directing charge species emitted from said corona generating electrode to the layer of marking material.

8. An imaging apparatus in accordance with claim 1 wherein said charging source includes a plurality of independent corona generating electrodes and associated charge deposition control devices.

9. An imaging apparatus in accordance with claim 8 wherein said plurality of independent corona generating electrodes includes a first corona generating electrode for providing charge species of a first charge polarity; and a second corona generating electrode for providing charge species of a second charge polarity.

10. An imaging apparatus in accordance with claim 1 wherein said separator member is adapted to attract marking material layer image areas associated with the latent image away from the support member so as to maintain marking material layer nonimage areas associated with the latent image on the surface of the support member, or wherein said separator member is optionally adapted to attract marking material layer nonimage areas associated with the latent image away from the support member so as to maintain marking material layer image areas associated with the latent image on the surface of the support member.

11. An imaging apparatus in accordance with claim 1 further including a transfer system for transferring the developed image to a copy substrate to produce an output copy thereof.

12. An imaging apparatus in accordance with claim 1 further including a cleaning apparatus for removing marking material layer nonimage areas associated with the latent image from the surface of said support member.

13. An imaging process comprising depositing from a liquid developer toner particles on a support member to form a toner layer thereon;

selectively delivering charges to the toner layer on said support member in an imagewise manner for forming an eletrostatic latent image in the toner layer with image areas of a first charge voltage and nonimage areas of a second charge voltage distinguishable from the first charge voltage; and selectively separating portions of the toner layer from the support member in accordance with the latent image in the toner layer for creating a developed image, and wherein said liquid developer is comprised of an optional liquid, colorant, resin, and a cyclodextrin charge acceptance agent, and wherein said cyclodextrin captures negative ions or positive ions thereby enabling a negatively charged liquid developer or a positively charged liquid developer, respectively.

14. An imaging process in accordance with claim 13 wherein said toner depositing step includes depositing a layer of uncharged toner particles on the surface of the support member, or wherein said toner depositing step includes depositing a layer of charged toner particles on the surface of the support member.

15. An imaging process in accordance with claim 13 wherein said toner depositing step includes forming a toner layer having a thickness in a range of between approximately 3 and about 8 microns on the surface of the support member.

16. An imaging process in accordance with claim 13 wherein said toner depositing includes depositing liquid developing material including toner particles immersed in a liquid carrier medium.

17. An imaging process in accordance with claim 16 wherein said toner depositing is adapted to deposit a toner layer having a toner solids percentage by weight in a range between approximately 15 percent and about about 35 percent.

18. An imaging process in accordance with claim 13 wherein said selectively separating portions of the toner layer from the support member further includes providing an electrical bias to the member having a peripheral surface for contacting the toner layer to electrically attract selectively charged portions of the toner layer away from the support member.

19. An electrostatographic image development apparatus, comprising means for depositing a layer of marking particles on a support member;

means for creating a selective electrical discharge in a vicinity of the layer of marking particles on the support member to selectively charge the layer of marking particles so as to create an electrostatic latent image in the layer of marking particles; and means for selectively separating portions of the layer of marking parficles in accordance with the electrostatic latent image for creating a developed image corresponding to the electrostatic latent image formed in the layer of marking particles, and wherein said marking particles are comprised of a resin, colorant, and a cyclodextrin charge acceptance component; and wherein said cycolodextrin captures negative ions or positive ions thereby enabling a negatively charged liquid developer or a positively charged liquid developer, respectively.

20. An electrostatographic image development apparatus in accordance with claim 19 wherein the layer of marking particles deposited on the support member includes uncharged or electrically charged toner particles of colorarit, resin and cyclodextrin.

21. An electrostatographic image development apparatus in accordance with claim 18 wherein the liquid developing material includes a toner solids percentage by weight in a range of between about 15 percent and about 35 percent.

22. An electrostatographic image development process comprising depositing a layer of marking particles on a support member;

selectively charging the layer of marking particles for creating an electrostatic latent image in the layer of marking particles: and selectively separating portions of the layer of marking particles in accordance with the electrostatic latent image for creating a developed image, and wherein said marking particles are comprised of resin, colorant, and a cyclodextrin charge acceptance component; and wherein said cyclodextrin captures negative ions or positive ions thereby enabling a negatively charged liquid developer or a positively charged liquid developer, respectively.

23. An apparatus in accordance with claim 1 wherein said charge acceptance component is comprised of unsubstituted alpha, beta or gamma cyclodextrin or mixtures thereof of the following formulas

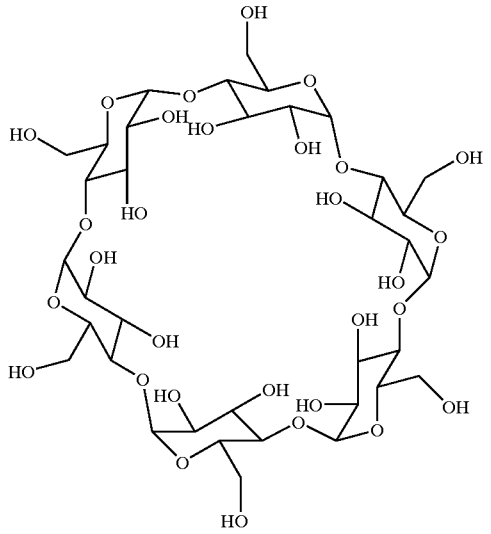

alpha-Cyclodextrin: 6 D-glucose rings containing 18 hydroxyl groups;

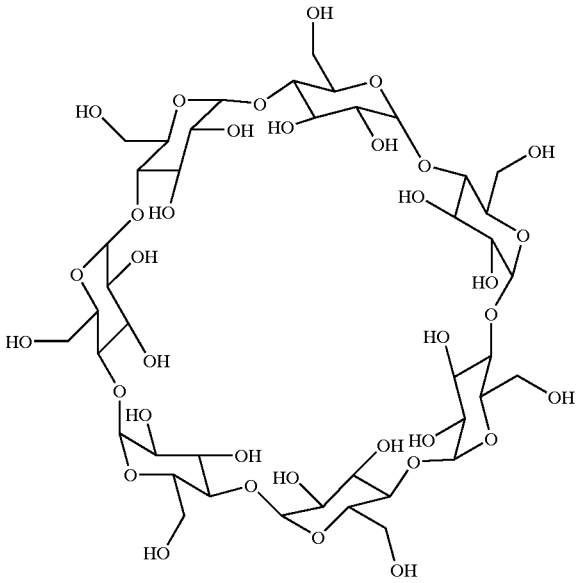

beta-Cyclodextrin: 7 D-glucose rings containing 21 hydroxyl groups; or

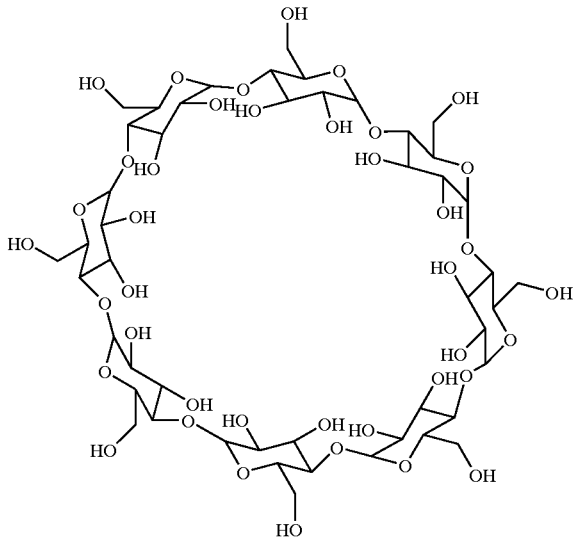

gamma-Cyclodextrin: 8 D-glucose rings containing 24 hydroxyl groups.

24. An apparatus in accordance with claim 1 wherein said charge acceptance component is comprised of a tertiary aliphatic amino derivative of alpha, beta or gamma cyclodextrin or mixtures thereof of the following formulas wherein n is an integer of from 2 to 30, and $R^1$ and $R^2$ is an alkyl group containing from 2 to 30 carbons, an alkylaryl group containing from 7 to 31 carbons, a cycloalkyl or alkylcycloalkyl group, each containing from 3 to 30 carbons, or a cycloalkyl or heterocycloalkyl group, each containing from 3 to 30 carbons, wherein $R^1$ and $R^2$ are joined in a ring structure with a covalent bond, or by covalent bonding to a common divalent heteroatom of oxygen, sulfur or another tertiary alkyl nitrogen group wherein the degree of substitution can vary from 1 to 18, or 21, or 24 of the hydroxyl groups of the selected cyclodextrin

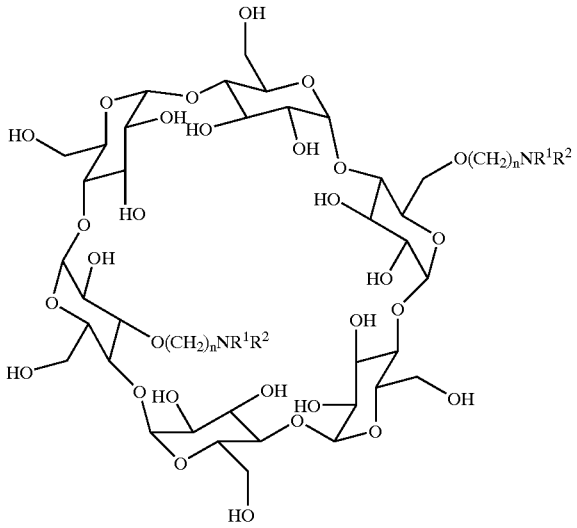

Tertiary Amino Alpha Cyclodextrin;

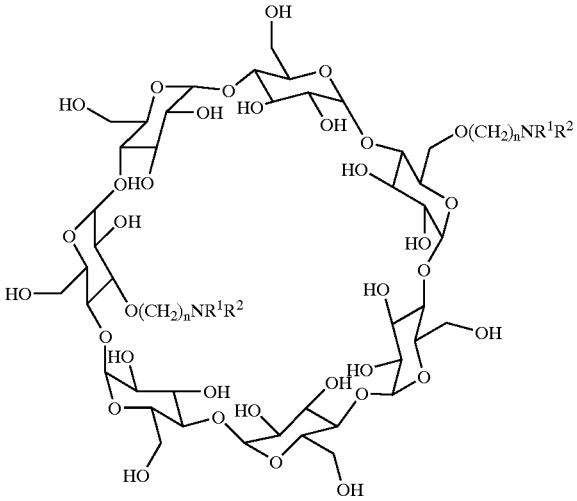

Tertiary Amino Beta Cyclodextrin; or

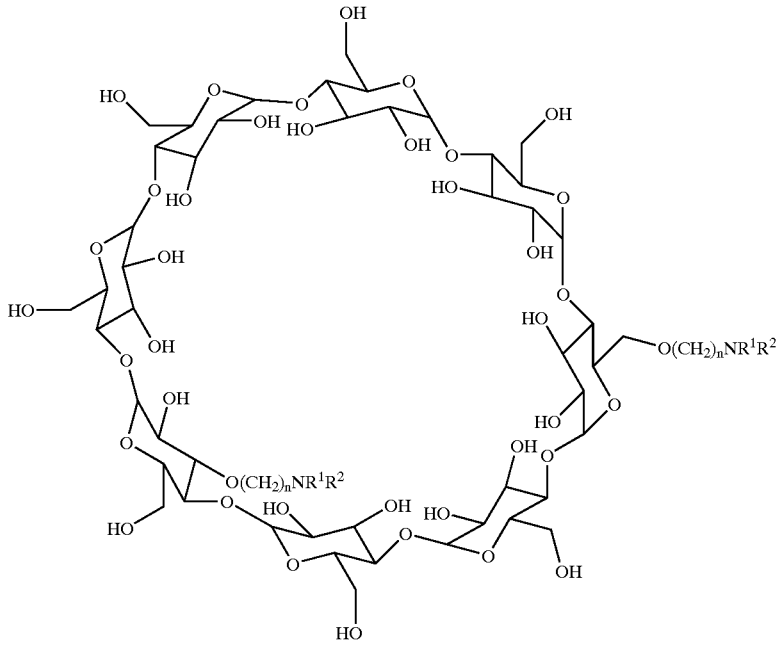

Tertiary Amino Gamma Cyclodextrin.

25. An apparatus in accordance with claim 1 wherein the resin is a copolymer of ethylene and vinyl acetate, an alkylene polymer, a styrene polymer, an acrylate polymer, a polyester, copolymers thereof, or mixtures thereof.

26. An apparatus in accordance with claim 1 wherein the colorant is present in an amount of from about 0.1 to about 60 percent by weight based on the total weight of the developer solids.

27. An apparatus in accordance with claim 1 wherein the charge acceptance agent is present in an amount of from about 0.05 to about 10 weight percent based on the weight of the developer solids of resin, colorant, and charge acceptance agent.

28. An apparatus in accordance with claim 1 wherein the cyclodextrin is alpha cyclodextrin, or N,N-diethylamino-N-2-ethyl beta cyclodextrin.

29. An apparatus in accordance with claim 1 wherein the cyclodextrin is beta cyclodextrin, or wherein the cyclodextrin is gamma cylodextrin.

30. An apparatus in accordance with claim 1 wherein the liquid for said developer is an aliphatic hydrocarbon.

31. An apparatus in accordance with claim 1 wherein the developer is clear in color and contains no colorant.

32. An imaging apparatus in accordance with claim 1 wherein said cyclodextrin captures positive ions.

33. An imaging apparatus in accordance with claim 1 wherein said cyclodextrin captures negative ions.

* * * * *